US010561296B2

(12) United States Patent
Wilson et al.

(10) Patent No.: US 10,561,296 B2
(45) Date of Patent: Feb. 18, 2020

(54) DISHWASHER WITH DOCK DETECTION

(71) Applicant: Midea Group Co., Ltd., Beijiao (CN)

(72) Inventors: Mark W. Wilson, Simpsonville, KY (US); Timothy Martin Wetzel

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 40 days.

(21) Appl. No.: 15/382,083

(22) Filed: Dec. 16, 2016

(65) Prior Publication Data

US 2018/0168425 A1 Jun. 21, 2018

(51) Int. Cl.

| | |
|---|---|
| ***A47L 15/50*** | (2006.01) |
| ***A47L 15/46*** | (2006.01) |
| ***A47L 15/00*** | (2006.01) |
| ***A47L 15/22*** | (2006.01) |
| ***A47L 15/42*** | (2006.01) |

(52) U.S. Cl.

CPC ..... *A47L 15/46* (2013.01); *A47L 15/0028* (2013.01); *A47L 15/22* (2013.01); *A47L 15/4278* (2013.01); *A47L 15/4289* (2013.01); *A47L 15/502* (2013.01)

(58) Field of Classification Search

CPC ..... A47L 15/0049; A47L 15/508; A47L 15/50

See application file for complete search history.

(56) References Cited

U.S. PATENT DOCUMENTS

| | | | |
|---|---|---|---|
| 1,897,821 | A | 2/1933 | Poli |
| 2,012,178 | A | 8/1935 | Anderson |
| 2,596,693 | A | 5/1952 | Karlstrom |
| 2,664,904 | A | 1/1954 | Stokes et al. |
| 3,288,155 | A | 11/1966 | Swetnam |
| 3,319,640 | A | 5/1967 | Flame |
| 3,468,486 | A | 9/1969 | Mercer |
| 3,496,949 | A | 2/1970 | Mercer |
| 3,708,120 | A | 1/1973 | Camprubi et al. |
| 3,718,149 | A | 2/1973 | Mazza |
| 3,727,622 | A | 4/1973 | Jacobs |
| 3,779,258 | A | 12/1973 | Brenner et al. |
| 3,890,987 | A | 6/1975 | Marcussen et al. |
| 3,903,911 | A | 9/1975 | Guth |

(Continued)

FOREIGN PATENT DOCUMENTS

| | | | |
|---|---|---|---|
| CN | 2157738 | Y | 3/1994 |
| CN | 1153330 | A | 7/1997 |

(Continued)

OTHER PUBLICATIONS

JPH10180212—Machine Translation (Year: 1998).*

(Continued)

*Primary Examiner* — Marc Lorenzi

(74) *Attorney, Agent, or Firm* — Middleton Reutlinger

(57) ABSTRACT

A method and a dishwasher utilize a dock detection system to determine when a connector of a spray device is docked to a docking port provided on a manifold of the dishwasher. A dock detector is coupled to the docking port and is electrically coupled to a controller of the dishwasher through electrical conductors that extend along the manifold, thereby enabling a dishwasher controller to detect when spray devices are coupled to the manifold, e.g., to optimize a wash cycle to use a particular spray device docked to the docking port.

23 Claims, 10 Drawing Sheets

(56) References Cited

U.S. PATENT DOCUMENTS 3,915,182 A 10/1975 Payne
3,941,139 A 3/1976 Spiegel
4,498,594 A 2/1985 Elder
4,512,489 A 4/1985 Green
4,784,168 A 11/1988 Erminio
5,131,419 A 7/1992 Roberts
5,331,986 A 7/1994 Lim et al.
5,431,294 A 7/1995 Stottmann et al.
5,655,740 A 8/1997 Lazarus
5,697,392 A 12/1997 Johnson et al.
5,816,273 A 10/1998 Milocco et al.
5,882,739 A 3/1999 Kobos et al.
5,964,232 A 10/1999 Chung
6,003,529 A 12/1999 Perry, Jr.
6,666,218 B2 12/2003 Lavoie et al.
6,758,227 B2 7/2004 Lee et al.
6,976,496 B2 12/2005 Cantrell et al.
7,100,623 B2 9/2006 Assmann et al.
7,137,397 B2 11/2006 Rosenbauer et al.
7,231,929 B2 6/2007 Landsiedel et al.
7,270,132 B2 9/2007 Inui et al.
7,331,356 B2 2/2008 VanderRoest et al.
7,445,013 B2 11/2008 VanderRoest et al.
7,475,696 B2 1/2009 VanderRoest et al.
7,478,642 B2 1/2009 Koch et al.
7,523,757 B2 4/2009 Cantrell et al.
7,523,758 B2 4/2009 VanderRoest et al.
7,594,513 B2 9/2009 VanderRoest et al.
7,690,517 B2 4/2010 Purushothaman et al.
7,754,024 B2 7/2010 Koch et al.
7,754,026 B2 7/2010 Kehl
7,794,550 B2 9/2010 Roth
7,896,977 B2 3/2011 Gillum et al.
7,935,194 B2 5/2011 Rolek
7,947,132 B2 5/2011 VanderRoest et al.
7,959,744 B2 6/2011 Sundaram et al.
7,980,260 B2 7/2011 Bertsch et al.
7,988,791 B2 8/2011 Delgado
8,007,598 B2 8/2011 Chen et al.
8,113,222 B2 2/2012 Bertsch et al.
8,137,479 B2 3/2012 VanderRoest et al.
8,187,390 B2 5/2012 VanderRoest et al.
8,210,191 B2 7/2012 Gnadinger et al.
8,211,243 B2 7/2012 Delgado
8,347,898 B2 1/2013 Fountain et al.
8,349,089 B2 1/2013 Bertsch et al.
8,454,762 B2 6/2013 VanderRoest et al.
8,454,763 B2 6/2013 VanderRoest et al.
8,485,205 B2 7/2013 Fountain et al.
8,701,898 B2 4/2014 Chai
8,753,454 B2 6/2014 VanderRoest et al.
8,764,908 B2 7/2014 VanderRoest et al.
8,778,094 B2 7/2014 Blanchard et al.
8,801,863 B2 8/2014 Blanchard et al.
8,801,868 B2 8/2014 Carlson et al.
8,808,467 B2 8/2014 VanderRoest et al.
8,852,351 B2 10/2014 Tuller
8,871,031 B2 10/2014 Carlson et al.
8,932,411 B2 1/2015 Beaudet et al.
8,967,165 B2 3/2015 Buddharaju et al.
9,034,109 B2 5/2015 Tuller
9,034,112 B2 5/2015 Tuller et al.
9,113,766 B2 8/2015 Tuller et al.
9,119,517 B2 9/2015 Carlson et al.
9,119,523 B2 9/2015 McDaniel et al.
9,155,447 B2 10/2015 Baldwin et al.
9,161,674 B2 10/2015 Garnett
9,161,677 B2 10/2015 Hofpeter et al.
9,241,607 B2 1/2016 Porcaro, II et al.
9,259,138 B2 2/2016 Chen et al.
9,301,670 B2 4/2016 Dalsing et al.
9,421,546 B2 8/2016 Robert et al.
9,474,434 B2 10/2016 Carlson et al.
9,661,982 B2 5/2017 Dabade et al.
2002/0185166 A1 12/2002 Rosenbauer et al.
2004/0118427 A1* 6/2004 Palfy ..... A61C 17/036 134/1
2004/0173249 A1 9/2004 Assmann et al.
2005/0039777 A1 2/2005 Jerg et al.
2005/0109378 A1 5/2005 Landsiedel et al.
2005/0150529 A1 7/2005 VanderRoest et al.
2005/0241686 A1 11/2005 Woo
2006/0113260 A1 6/2006 Purushothaman et al.
2006/0201538 A1 9/2006 Christman et al.
2006/0254626 A1* 11/2006 Botts ..... A47L 15/0055 134/110
2007/0006903 A1 1/2007 Kock et al.
2007/0056613 A1 3/2007 Haas et al.
2009/0071514 A1 3/2009 Roth
2009/0120474 A1 5/2009 Kehl
2009/0159103 A1 6/2009 Gillum et al.
2009/0178698 A1 7/2009 Delgado
2010/0012158 A1 1/2010 Rosenbauer et al.
2010/0051069 A1 3/2010 Schessl et al.
2010/0101611 A1 4/2010 Chen et al.
2010/0116296 A1 5/2010 Bertsch et al.
2010/0126526 A1* 5/2010 Poyner ..... A47L 15/0049 134/18
2010/0161143 A1* 6/2010 Smith ..... A47L 15/4418 700/283
2011/0247990 A1 10/2011 Chai
2012/0138110 A1* 6/2012 Chen ..... A47L 15/0018 134/198
2012/0167927 A1 7/2012 Shin
2012/0222711 A1 9/2012 Forst et al.
2012/0291827 A1 11/2012 Buddharaju et al.
2013/0112225 A1 5/2013 Im et al.
2013/0186434 A1 7/2013 Ghosh et al.
2013/0228202 A1 9/2013 Welch et al.
2013/0269736 A1 10/2013 Baldwin et al.
2014/0090675 A1 4/2014 Carlson et al.
2014/0130833 A1 5/2014 Ryu et al.
2014/0130834 A1* 5/2014 Baldwin ..... A47L 15/508 134/198
2014/0137909 A1 5/2014 Baldwin et al.
2014/0137911 A1 5/2014 Baldwin et al.
2014/0190525 A1 7/2014 Porcaro et al.
2014/0190534 A1 7/2014 Boyer
2014/0332042 A1 11/2014 Blanchard et al.
2015/0007861 A1 1/2015 Azmi et al.
2015/0028733 A1 1/2015 Patil et al.
2015/0136187 A1 5/2015 Carlson et al.
2015/0150430 A1 6/2015 Wee et al.
2015/0164299 A1 6/2015 Naik
2015/0201823 A1 7/2015 Poojary et al.
2015/0208899 A1 7/2015 Lee et al.
2015/0245762 A1 9/2015 Tuller
2015/0250374 A1 9/2015 McDaniel et al.
2015/0257623 A1 9/2015 Beshears, Jr. et al.
2015/0272421 A1 10/2015 Benedict et al.
2015/0305593 A1 10/2015 Debade et al.
2015/0327747 A1 11/2015 Carlson et al.
2015/0352605 A1 12/2015 Tiwari
2015/0366430 A1 12/2015 Ross et al.
2015/0374203 A1 12/2015 Hirsh et al.
2018/0110395 A1 4/2018 Thiyagarajan

FOREIGN PATENT DOCUMENTS

CN 101049244 A 10/2007
CN 101327113 A 12/2008
CN 101980650 A 2/2011
CN 201727486 U 2/2011
CN 203763025 U 8/2014
CN 104433985 A 3/2015
CN 104644096 A 5/2015
CN 204427981 U 7/2015
CN 204445746 U 7/2015
CN 204467990 U 7/2015
CN 104840165 A 8/2015
CN 204542007 U 8/2015
CN 105962867 A 9/2016
CN 106073675 A 11/2016

(56) References Cited

FOREIGN PATENT DOCUMENTS

| | | | |
|---|---|---|---|
| DE | 1417444 | U | 10/1974 |
| DE | 2946591 | C2 | 8/1987 |
| DE | 10332149 | B3 | 5/2005 |
| DE | 102013211564 | A1 | 12/2014 |
| DE | 202014100156 | U1 | 2/2015 |
| EP | 1676521 | A2 | 7/2006 |
| GB | 2440904 | A | 2/2008 |
| JP | H10180212 | A | 7/1998 |
| JP | 2000325287 | A | 11/2000 |
| JP | 2009005925 | A1 | 7/2014 |
| KR | 20060031312 | A | 4/2006 |
| WO | 2014107123 | A1 | 7/2014 |
| WO | 2015090433 | A1 | 6/2015 |
| WO | 2015185076 | A1 | 12/2015 |

OTHER PUBLICATIONS

U.S. Patent Office; Office Action issued in U.S. Appl. No. 15/382,071 dated Jun. 29, 2018.
U.S. Patent Office; Restriction Requirement issued in Application No. 15/382,100 dated May 3, 2018.
Citation of Related U.S. Patents and/or Applications, dated Feb. 20, 2018.
General Electric Company, "GE Café Series Stainless Interrior Built-In Dishwasher with Hidden Controls," 2016.
List of Citations of Related US Patents and or Patent Applications.
General Electric Company, "Puts Their Jets Where the Dirt Is: Over 140 Dishwasher Jets Ensure Thorough Cleaning," 2016.
U.S. Patent Office; Office Action issued in U.S. Appl. No. 15/382,055, dated Oct. 2, 2018.
U.S. Patent Office; Office Aciton issued in U.S. Appl. No. 15/382,071, dated Jun. 29, 2018.
U.S. Patent Office; Office Action issued in U.S. Appl. No. 15/382,090 dated Jul. 27, 2018.
International Search Report and Written Opinion issued in Application No. PCT/CN2017/102127 dated Dec. 22, 2017.
International Search Report and Written Opinion issued in Application No. PCT/CN2017/102126 dated Dec. 25, 2017.
International Search Report and Written Opinion issued in Application No. PCT/CN2017/102136 dated Nov. 28, 2017.
International Search Report and Writtien Opinion issued in Application No. PCT/CN2017/102134 dated Dec. 21, 2017.
International Search Report and Written Opinion issued in Application No. PCT/CN2017/102128 dated Dec. 21, 2017.
U.S. Patent Office; Restriction Requirement issued in U.S. Appl. No. 15/382,100 dated Oct. 30, 2018.
U.S. Patent Office; Notice of Allowance issued in U.S. Appl. No. 15/382,071 dated Feb. 7, 2019.
U.S. Patent Office; Notice of Allowance issued in U.S. Appl. No. 15/382,090 dated Feb. 19, 2019.
U.S. Patent Office; Office Action issued in U.S. Appl. No. 15/382,100 dated Mar. 25, 2019.
U.S. Patent Office; Notice of Allowance issued in U.S. Appl. No. 15/382,055 dated May 1, 2019.
U.S. Patent Office; Office Action issued in U.S. Appl. No. 15/382,100 dated Sep. 13, 2019.

* cited by examiner

DISHWASHER WITH DOCK DETECTION

BACKGROUND

Dishwashers are used in many single-family and multi-family residential applications to clean dishes, silverware, cutlery, cups, glasses, pots, pans, etc. (collectively referred to herein as "utensils"). Due to the wide variety of items that may need to be cleaned by a dishwasher, many dishwashers provide various containers and/or specialized sprayers to address different washing needs. Many dishwashers, for example, include multiple sliding racks including arrangements of tines that can be used to separate and orient dishes, bowls, glasses, etc. to receive directed sprays of fluid from one or more rotating wash arms. In addition, many dishwashers include removable silverware baskets that may be positioned in dedicated locations on racks, and in some dishwashers, directed sprays are provided to provide deeper cleaning. Other dishwashers include dedicated high pressure spray zones to direct additional spraying power at particularly soiled items. Despite these various dedicated washing features, however, conventional dishwashers still lack flexibility in terms of address different consumer washing needs.

SUMMARY

The herein-described embodiments address these and other problems associated with the art by providing a method and a dishwasher including a dock detection system to determine when a connector of a spray device is docked to a docking port provided on a manifold of the dishwasher. A dock detector is coupled to the docking port and is electrically coupled to a controller of the dishwasher through electrical conductors that extend along the manifold, thereby enabling a dishwasher controller to detect when spray devices are coupled to the manifold, e.g., to optimize a wash cycle to use a particular spray device docked to the docking port.

Therefore, consistent with one aspect of the invention, a dishwasher may include a wash tub, a pump configured to recirculate fluid within the wash tub, a controller electrically coupled to the pump, a manifold including a fluid inlet in fluid communication with the pump and a docking port in fluid communication with the fluid inlet, a dock detector coupled to the docking port and configured to detect docking of a spray device connector to the docking port, and first and second electrical conductors extending along the manifold between the fluid inlet and the docking port. The first and second electrical conductors are electrically coupled to the dock detector to communicate an electrical signal between the dock detector and the controller to indicate when the spray device connector is docked to the docking port.

In addition, in some embodiments, the dock detector includes first and second conductive pads respectively and electrically coupled to the first and second electrical conductors, where the first and second conductive pads are disposed proximate the docking port and electrically isolated from one another when no spray device connector is docked to the docking port, and where the first and second conductive pads are electrically coupled to one another when the spray device connector is docked to the docking port. In some embodiments, the spray device connector includes one or more conductive surfaces configured to mate with each of the first and second conductive pads when the spray device connector is docked to the docking port, and in some embodiments, the first and second conductive pads are disposed in a common plane and circumscribe an opening of the docking port, and the one or more conductive surfaces of the spray device connector include an annular conductive surface that mates with the first and second conductive pads when the spray device connector is docked to the docking port.

In some embodiments, the dock detector includes a continuity detector that electrically couples the first and second electrical conductors to one another when the spray device connector is docked to the docking port. Also, in some embodiments, the dock detector includes a contact switch having open and closed states and including first and second contacts, at least one of the first and second contacts configured to be displaced when the spray device connector is docked to the docking port to switch between the open and closed states. Further, in some embodiments, the dock detector includes a magnetic sensor having open and closed states and including first and second contacts, at least one of the first and second contacts configured to be displaced in response to a magnetic field, where the spray device connector includes a magnet such that the at least one of the first and second contacts is displaced to switch the magnetic sensor between the open and closed states when the spray device connector is docked to the docking port. In addition, in some embodiments, the dock detector includes an inductive proximity sensor, a capacitive proximity sensor, a magnetic proximity sensor, a photoelectric proximity sensor, an optical sensor or a Hall Effect sensor configured to detect when the spray device connector is docked to the docking port. In some embodiments, the dock detector includes a wireless sensor configured to detect a wireless signal generated by a passive or active element on the spray device connector.

Further, in some embodiments, the manifold includes a fluid conduit, where the docking port is disposed on the fluid conduit, and where the first and second electrical conductors extend along the fluid conduit. In addition, in some embodiments, the first and second electrical conductors are embedded in the fluid conduit. Further, in some embodiments, the first and second electrical conductors are formed on an inner or outer surface of the fluid conduit.

Some embodiments may further include a rack disposed in the wash tub and configured to support a plurality of utensils to be washed, where the manifold is coupled to the rack, and a port disposed on a wall of the wash tub and in fluid communication with the pump. The rack is configured to move between loading and washing positions along a substantially horizontal direction, the fluid inlet of the manifold is configured to mate with the port disposed on the wall of the wash tub when the rack is moved to the washing position such that the manifold is in fluid communication with the pump when the rack is moved to the washing position, and the fluid inlet and the port disposed on the wall of the wash tub include cooperative electrical contacts respectively and electrically coupled to the controller and to the first and second electrical conductors.

In some embodiments, the manifold is supported on a rack and further includes a plurality of docking ports in fluid communication with the fluid inlet, the plurality of docking ports disposed at a plurality of locations in the rack, a plurality of valves respectively coupled to the plurality of docking ports, each valve configured to seal the respective docking port when the respective docking port is unused, and a plurality of dock detectors respectively coupled to the plurality of docking ports and configured to detect docking of a spray device connector to the respective docking ports. In some embodiments, the plurality of dock detectors are electrically coupled to the first and second electrical conductors, and the controller is configured to determine when the spray device connector is docked to any of the plurality of docking ports. In addition, in some embodiments, the plurality of dock detectors are coupled in parallel to one another, and the spray device connector forms a bridge between the first and second electrical conductors when docked to one of the plurality of docking ports.

Moreover, in some embodiments, each of the plurality of dock detectors is electrically coupled to the controller using at least one dedicated electrical conductor, and the controller is configured to determine to which of the plurality of dock detectors the spray device connector is docked. In some embodiments, the manifold further includes at least one electrical component associated with a first docking port among the plurality of docking ports and configured to communicate a signal to the controller, and the controller is configured to determine that the spray device connector is docked to the first docking port based upon the signal communicated by the at least one electrical component. In addition, in some embodiments, the electrical component is a passive electrical component that communicates the signal by varying an electrical characteristic of an input signal communicated to the electrical component to identify the first docking port to the controller. Further, in some embodiments, the electrical component is an active electrical component that generates an analog or digital signal to identify the first docking port to the controller.

Also, in some embodiments, the docking port is configured to couple with a plurality of different types of spray devices, and the dock detector is configured to determine a spray device type when the spray device connector is docked to the docking port. Moreover, in some embodiments, the docking port is configured to supply electrical power to the spray device connector when the spray device connector is docked to the docking port to control a motor, valve or electrical circuit of a spray device. Moreover, in some embodiments, the controller is configured to poll the dock detector to determine whether the spray device connector is docked to the docking port and control at least one wash cycle parameter during a wash cycle in response to determining that the spray device connector is docked to the docking port, and in some embodiments, the wash cycle parameter is a wash segment time, a wash cycle time, a fluid pressure, a fluid amount, a fluid temperature, a diverter valve setting, or a control valve setting.

Consistent with another aspect of the invention, a method of operating a dishwasher may include, with a controller of the dishwasher, polling a dock detector coupled to a docking port of a manifold and in communication with the controller over first and second electrical conductors extending along the manifold between the docking port and a fluid inlet of the manifold to determine if a spray device connector is docked to the docking port, and with the controller, selectively directing a flow of fluid to the inlet of the manifold during a wash cycle in response to determining that the spray device connector is docked to the docking port.

Consistent with yet another aspect of the invention, a dishwasher may include a wash tub, a pump configured to recirculate fluid within the wash tub, a controller electrically coupled to the pump, and a rack disposed in the wash tub and configured to support a plurality of utensils to be washed. The rack may include a manifold including a fluid inlet in fluid communication with the pump and a plurality of docking ports in fluid communication with the fluid inlet, each docking port including first and second conductive pads physically separated and electrically isolated from one another, and first and second electrical conductors extending along the manifold between the fluid inlet and the docking port, the first electrical conductor electrically coupled to the first conductive pads of the plurality of docking ports and the second electrical conductor electrically coupled to the second conductive pads of the plurality of docking ports. Each of the plurality of docking ports may be configured to receive a spray device connector including conductive material that, when the spray device connector is docked thereto, contacts each of the first and second conductive pads to close an electrical circuit with the controller.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
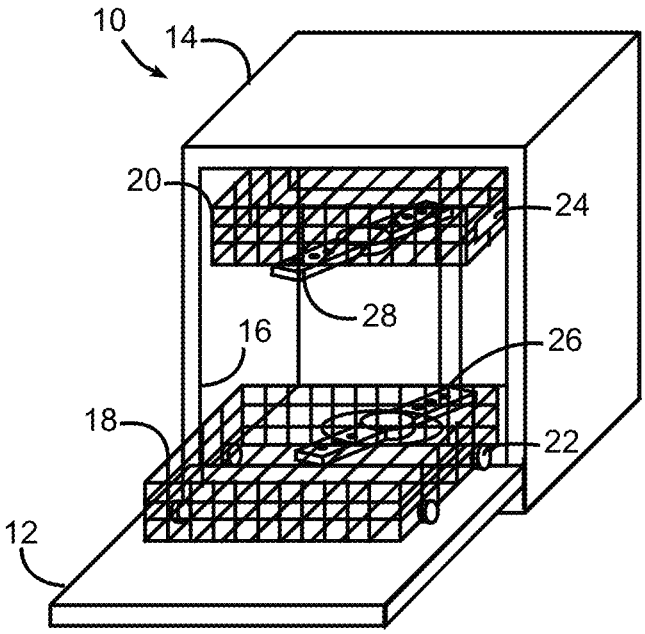
FIG. 1 is a perspective view of a dishwasher consistent with some embodiments of the invention.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. One or more rotating spray arms, e.g., lower spray arm 26 and upper spray arm 28, may also be provided to direct a spray of wash fluid onto utensils. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers.

Figure 2:
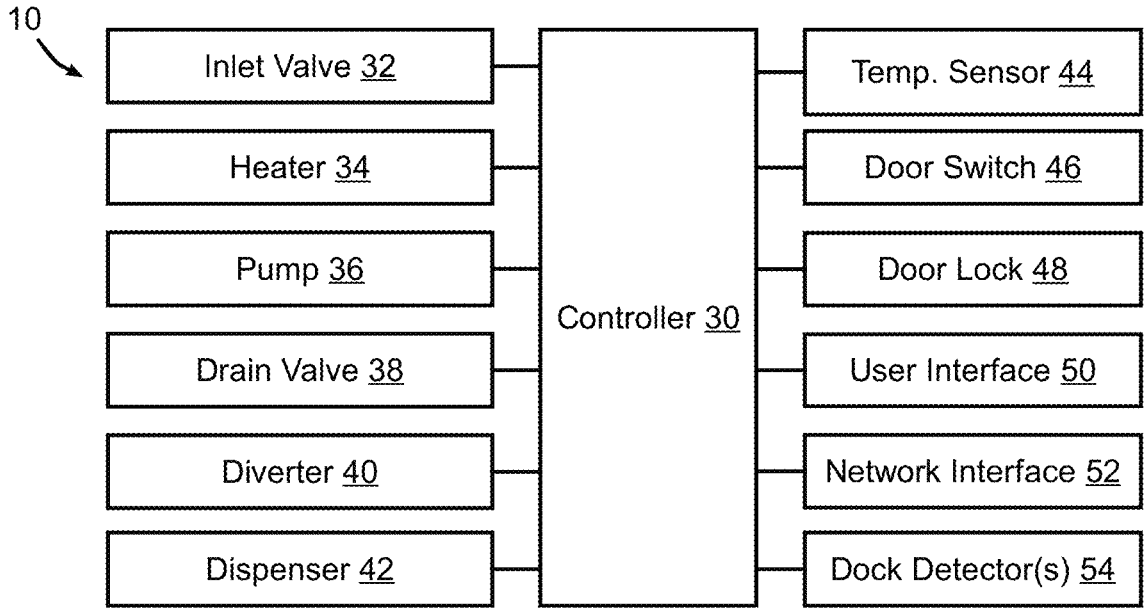
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various fluids. Controller may also be coupled to a heater 34 that heats fluids, a pump 36 that recirculates fluid within the wash tub by pumping fluid to the wash arms and other spray devices in the dishwasher, a drain valve 38 that is coupled to a drain to direct fluids out of the dishwasher, and a diverter 40 that controls the routing of pumped fluid to different wash arms and/or other sprayers during a wash cycle. In some embodiments, a single pump 36 may be used, and drain valve 38 may be configured to direct pumped fluid either to a drain or to the diverter 40 such that pump 36 is used both to drain fluid from the dishwasher and to recirculate fluid throughout the dishwasher during a wash cycle. In other embodiments, separate pumps may be used for draining the dishwasher and recirculating fluid. Diverter 40 in some embodiments may be a passive diverter that automatically sequences between different outlets, while in some embodiments diverter 40 may be a powered diverter that is controllable to route fluid to specific outlets on demand.

Controller 30 may also be coupled to a dispenser 42 to trigger the dispensing of detergent and/or rinse agent into the wash tube at appropriate points during a wash cycle. Additional sensors and actuators may also be used in some embodiments, including a temperature sensor 44 to determine a fluid temperature, a door switch 46 to determine when door 12 is latched, and a door lock 48 to prevent the door from being opened during a wash cycle. Moreover, controller 30 may be coupled to a user interface 50 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 52, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more port dock detectors 54 may be provided in some embodiments to detect when spray containers are docked in a rack manifold, as will be discussed in greater detail below.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Dishwasher with Modular Docking

Figure 3:
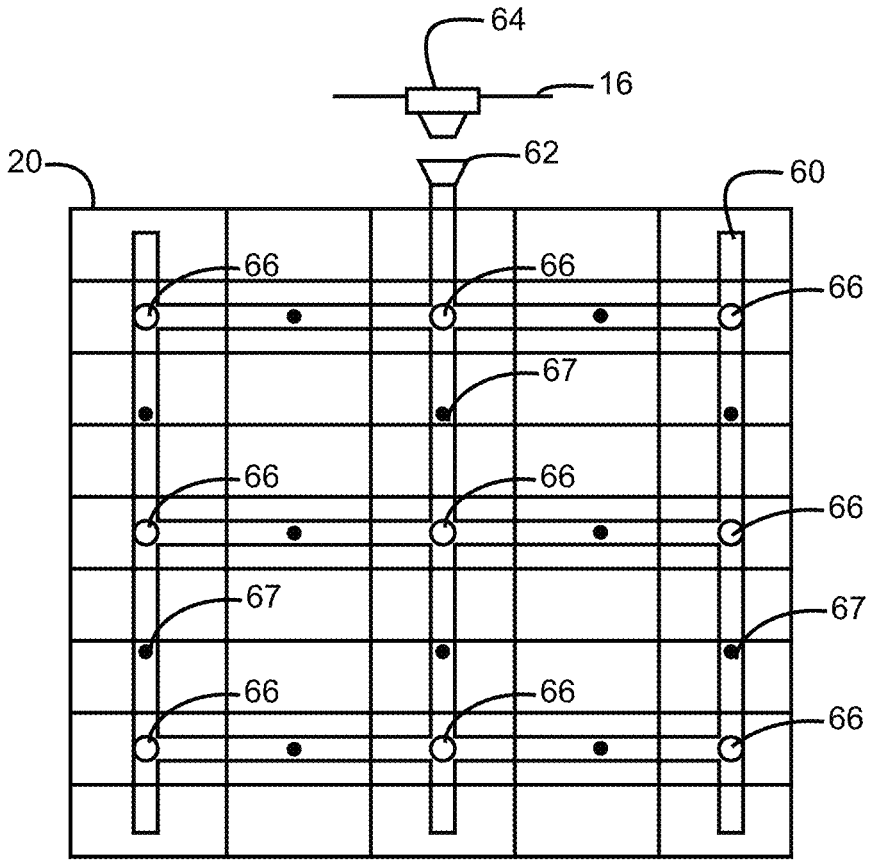
FIG. 3 is a top plan view of a rack from the dishwasher of FIG. 1.
Figure 4:
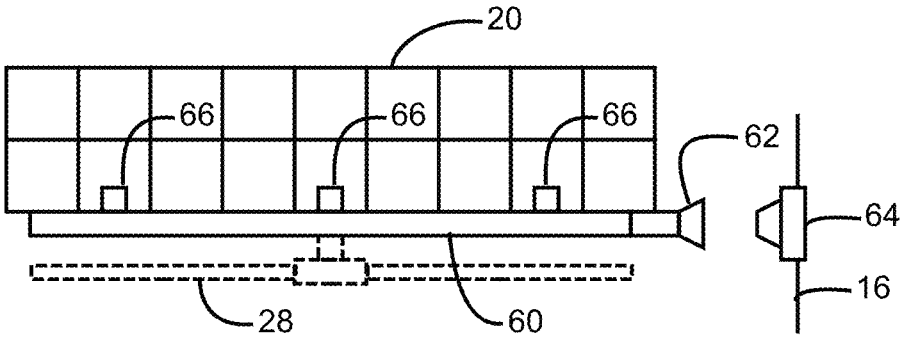
FIG. 4 is a side elevational view of a rack from the dishwasher of FIG. 1.

Now turning to FIGS. 3-4, in some embodiments, a modular docking system may be used to allow for the docking of various spray devices, including silverware baskets, nozzles, sprayers, spray containers at various locations within a dishwasher, including in some embodiments various locations within a rack of a dishwasher. In some embodiments, for example, a modular docking system may support docking of spray devices at multiple locations within an upper and/or lower rack of a dishwasher. In other embodiments, the multiple locations may be disposed elsewhere within a dishwasher, e.g., on a wall, floor or ceiling of a tub and/or on a door, and in some embodiments, the multiple locations may include locations disposed on one or more racks as well as locations elsewhere within a dishwasher.

For example, as illustrated in FIG. 3, a rack-mounted manifold, or rack manifold, 60 including one or more fluid conduits may be mounted onto a rack, e.g., rack 20. It will be appreciated that modular docking may be implemented for either or both of racks 18, 20. Further, in some embodiments rack manifold 60 may further supply fluid to additional spray devices, e.g., fixed sprayers mounted on a rack and/or a spray arm, e.g., spray arm 28 illustrated in FIG. 4. In other embodiments, a spray arm 28 may be supplied by a separate fluid supply from rack manifold 60. Rack manifold 60 may also be integrated into a rack or otherwise coupled thereto in various manners, e.g., within an interior portion of the rack or hanging below the rack along a lower surface thereof. It will also be appreciated that tines have been omitted from FIGS. 3-4 for reasons of clarity, but that rack 20 will generally include various fixed and/or movable tines to support utensils within the rack.

Manifold 60 may include a fluid inlet or plug 62 that mates with a corresponding port 64 mounted on a back wall of wash tub 16. Port 64 is in fluid communication with pump 36, e.g., through diverter 40, such that pressurized fluid is selectively output to manifold 60 during a wash cycle. Inlet 62 and port 64 are arranged relative to one another such that a manifold 60 is placed in fluid communication with port 64, and in turn to the pump, diverter valve and other fluid supply components when rack 20 is pushed back into wash tub 16 prior to starting a wash cycle. In other embodiments, a flexible conduit may be used to permanently couple manifold 60 to port 64, and in some embodiments, a check valve may be incorporated into port 64 to close the port when rack 20 is not fully pushed back into wash tub 16. Multiple ports 64 may also be provided at different elevations on wash tub 16 in some embodiments where a rack is height-adjustable.

Figure 5:
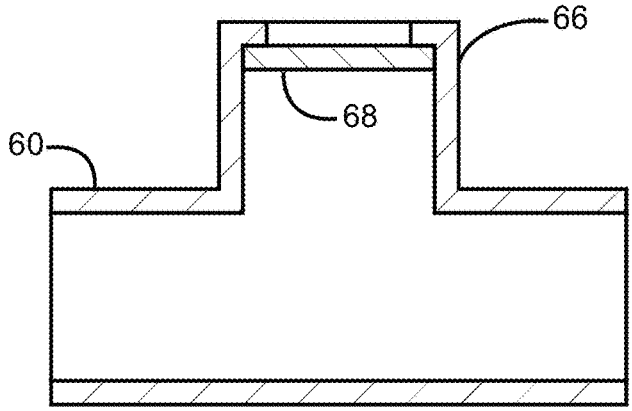
FIG. 5 is a side cross-sectional view of a port from the rack manifold illustrated in FIGS. 3 and 4.
Figure 6:
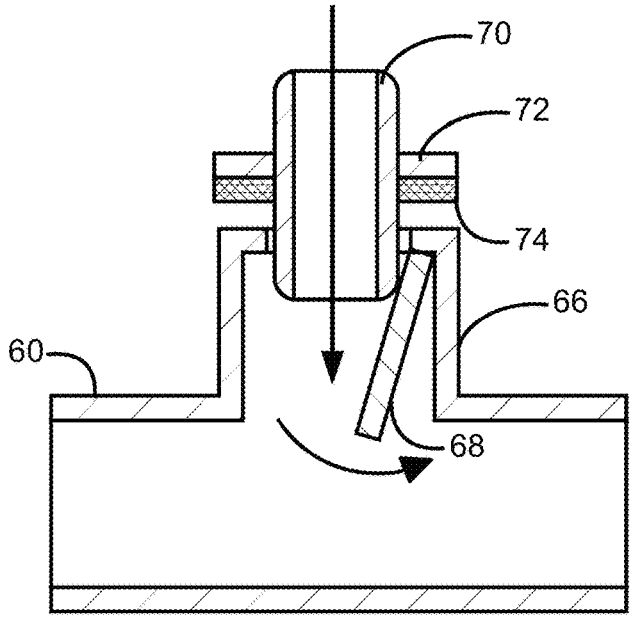
FIG. 6 illustrates insertion of a spray device coupler into the port of FIG. 5.

Manifold 60 further includes a plurality of docking ports 66 arranged in a regular array (e.g., a 3×3 array) and configured to receive cooperative plugs or connectors to mechanically and fluidally couple various spray devices to the manifold to support various combinations of spray devices in rack 20, i.e., such that when the connectors are mechanically coupled to the docking ports, flow paths are defined to place associated spray devices in fluid communication with the manifold. It will be appreciated that greater or fewer numbers of docking ports 66 may be provided by a rack manifold in other embodiments, and further, in some embodiments additional mechanical couplers or supports may further be integrated into a rack manifold to provide additional mechanical support for a spray device coupled to a rack manifold, e.g., by mating with cooperative mechanical couplers disposed on a spray device. For example, in some embodiments mechanical supports, e.g., pins 67, may be positioned intermediate (e.g., at midpoints between) docking ports 66 in some embodiments to mate with and provide additional mechanical support to a spray device coupled to rack manifold 60. In some embodiments, differing spacing may also be provided between docking ports 66 and/or between docking ports 66 and any supplemental mechanical supports. In some embodiments, the components in manifold 60 may be formed of plastic, metals and/or other materials, may be injection molded, blow molded, and/or extruded FIGS. 5 and 6 illustrate an example implementation of one of ports 66 in greater detail. In this implementation, each port 66 includes an integrated check valve 68, which is biased to the closed position illustrated in FIG. 5 by a spring (not shown) such that when port 66 is unused, i.e., no spray device is docked in port 66, the port is sealed to restrict the flow of fluid out of the manifold through the port. It will be appreciated that check valve 68 may be formed of rubber or other sealing material, or that a gasket may be coupled to check valve 68 or to the cooperative mating surface of port 66. Further, it will be appreciated that in other embodiments, other types of valves may be used to restrict the flow of fluid out of the manifold through the port when no spray device is docked in the port. The other types of valves can be biased to a closed position in the absence of a docked spray device in some embodiments, and in some embodiments, may be opened automatically in connection with docking a spray device into the port. Further, in some embodiments the valves may be manually actuatable or may be electrically or hydraulically actuatable under the control of controller 30.

Port 66 of FIG. 5 is configured to receive a cooperative plug or connector 70 of a spray device to provide a mechanical and fluid coupling with manifold 60, thereby placing one or more nozzles in the spray device in fluid communication with the manifold. As illustrated in FIG. 6, plug or connector 70 may be sized and configured to be received into port 66 and thereby push open check valve 68. In addition, plug or connector 70 may include a flange 72 that supports a gasket 74 to form a seal with port 66 when inserted beyond the position illustrated in FIG. 6. It will be appreciated that various alternate sealing mechanisms may be used, e.g., O-rings disposed on the shaft of plug or connector 70 and/or within port 66. Further, it will be appreciated that various mechanical couplings may be used to restrict removal of plug or connector 70 once inserted into port 66, including various rotary or spring-loaded locking mechanisms, friction fits, tabs, etc. It will be appreciated that a wide variety of mechanical couplings that provide for fluid connectivity and for easy insertion and removal, may be used in other embodiments, so the invention is not limited to the particular implementation illustrated in FIGS. 5-6.

Figure 7:
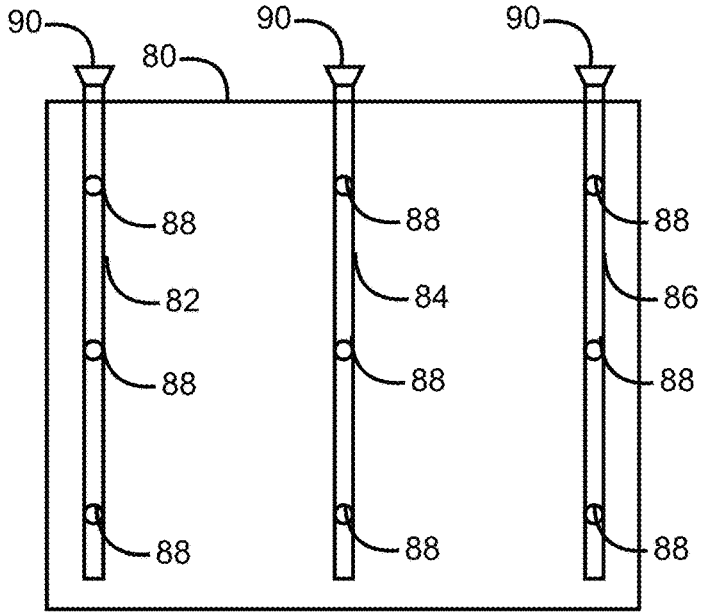
FIG. 7 is a top plan view of an alternate rack manifold to that illustrated in FIG. 3.

In some embodiments, rather than having a single manifold on a rack, multiple manifolds may be used on the same rack. Among other benefits, by providing multiple manifolds on a rack, each manifold may be selectively actuated during a wash cycle in some embodiments, e.g., through the use of separately-actuatable valves or through the use of diverter valve 40. FIG. 7, for example, illustrates a rack 80 including three manifolds 82, 84, 86, each with three ports 88 configured similar to ports 66, and each with a plug or inlet 90 configured similar to plug or inlet 62. It will be appreciated that different numbers of manifolds and different numbers of ports on each manifold may be used in other embodiments. It will also be appreciated that multiple manifolds 82, 84, 86 will generally necessitate providing multiple ports on wash tub 16. Multiple ports may also be provided at different elevations on wash tub 16 in some embodiments where a rack is height-adjustable. It will also be appreciated that one or more manifolds may be separate from a rack in some embodiments, and may be disposed on a door or elsewhere in a wash tub to provide docking locations in addition to or in lieu of docking locations in a rack.

Docking Detection

In addition, in some embodiments, it may be desirable to incorporate docking detection with modular docking. Docking detection, in particular, is used to detect when a spray device that requires a dedicated flow of fluid is connected to a fluid supply port within a dishwasher. Docking detection may also be used to detect whether or not fluid conduits or manifolds have docked with the main fluid supply conduit. If a connection is detected, then that information may be used to regulate fluid flow to that area or pathway in the hydraulic system. If a connection is not detected, then fluid may be diverted away or not supplied to that spray device, conduit or manifold. The detection of multiple fluid connections and/or connected spray devices may be used to determine whether or not the hydraulic system should sequence or alternate water flow to different spray devices, conduits and/or manifolds, and in some instances, may be used to automatically configure a wash cycle or select from among multiple types of wash cycles.

In some embodiments, docking detection may be implemented using conductive material attached to or embedded within a fluid conduit, e.g., a fluid manifold. Additionally, where fluid connections are made or spray devices are docked, then the mating part of the connection or spray device may incorporate a conductive connector or bridge that completes a circuit pathway when the connection/docking is completed. A signal processor, which may be incorporated into the controller of the dishwasher, may then be used to determine if a connection is present or not, and this information may be used to make decisions regarding various dishwasher and/or algorithm parameters during a washing cycle. Some examples of decisions that may be made include but are not limited to: whether or not to supply fluid to a connection and/or spray device, whether or not to sequence the flow of fluid, how much fluid and/or pressure to provide, how long to run certain segments of a cycle, which dishwasher components to turn on/off, when to turn components on/off, etc.

Figure 8:
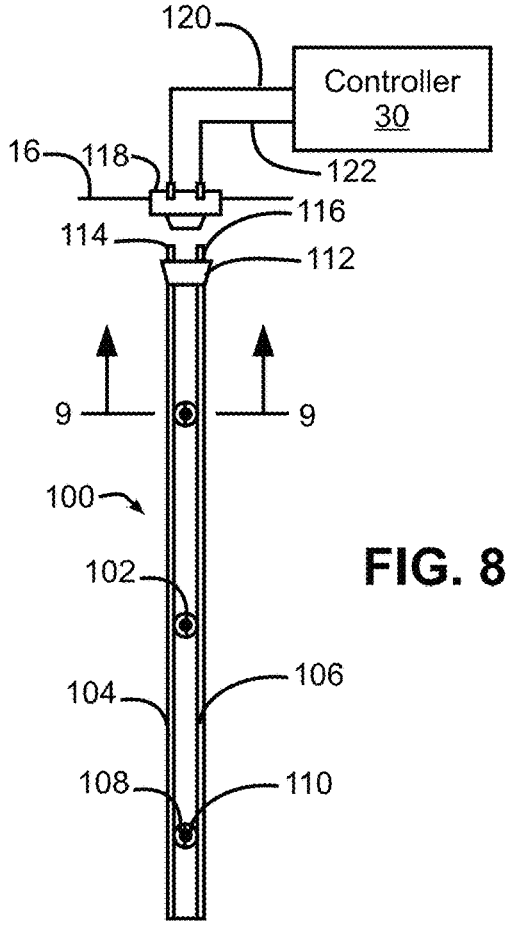
FIG. 8 is a functional top plan view illustrating a rack manifold prior to docking into a sidewall port of the dishwasher of FIG. 1.
Figure 9:
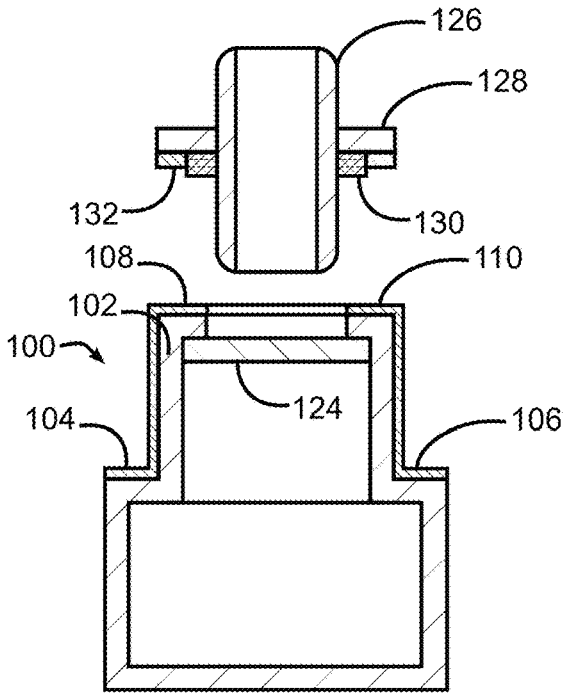
FIG. 9 is a cross-sectional view of a port from the rack manifold of FIG. 8, taken along lines 9-9 thereof.

FIG. 8, for example, illustrates an example implementation of docking detection, where a manifold 100 includes a plurality of ports 102 and a pair of electrical conductors 104, 106 extending along a fluid conduit of the manifold on opposite sides of ports 102. With further reference to FIG. 9, each port further includes a pair of electrical contacts or conductive pads 108, 110 disposed in a common plane on a mating surface of port 102. Conductive pads 108, 110 are electrically coupled to electrical conductors 104, 106, respectively, and operate as a continuity-type dock detector for a docking port 102. However, in the absence of a plug or connector of a spray device coupled to port 102, electrical conductors 104, 106 are electrically isolated from one another, as are conductive pads 108, 110, due to the physical separation between the conductive pads.

Manifold 100 also includes an inlet or plug 112 with a pair of pins 114, 116 respectively and electrically coupled to conductive traces 104, 106. A cooperative port 118 is disposed in the back wall of tub 16, and includes a pair of contacts respectively configured to couple with pins 114, 116 when plug 112 is received into port 118, and the contacts are coupled respectively to a pair of wires 120, 122 that are in turn in communication with controller 30 to enable controller 30 to detect when a spray device is docked in a port 102 of manifold 100 while plug 112 of manifold 100 is received in port 118.

FIG. 9 illustrates a cross-section of one of ports 102, including a check valve 124. A cooperative plug or connector 126 of a spray device is also illustrated, including a flange 128 having a washer 130 for sealing port 102 when plug or connector 126 is received in the port. Spray device connector 126 also includes conductive material, e.g., a conductive surface, that operates as an electrical bridge such that when the spray device connector is docked in the docking port, the conductive material contacts and bridges the conductive pads 108, 110 and thereby closes an electrical circuit with the controller. In this implementation, for example, the conductive material may be implemented as an annular conductive surface, e.g., a conductive ring 132 formed on flange 128, which provides a conductive surface circumferentially about the flange to mate with and electrically couple conductive pads 108, 110 when plug or connector 126 is received in port 102.

Figure 10:
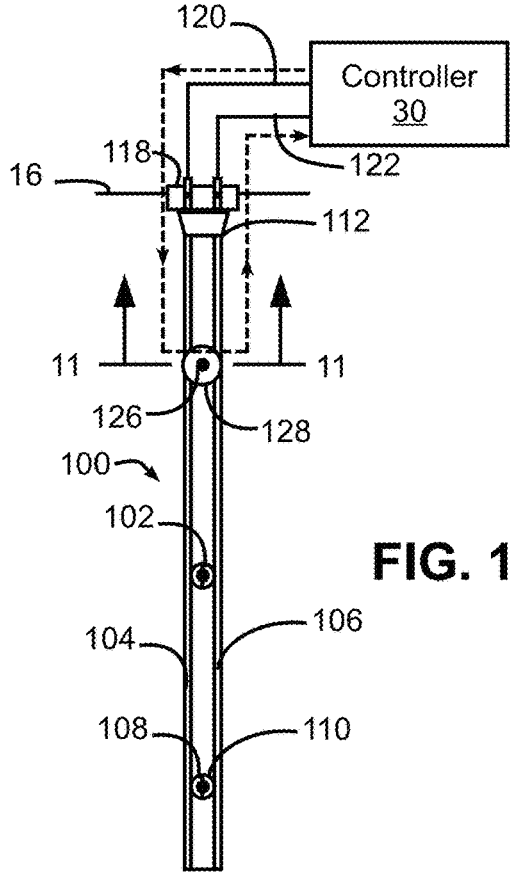
FIG. 10 illustrates the rack manifold of FIG. 8 after docking into the sidewall port.
Figure 11:
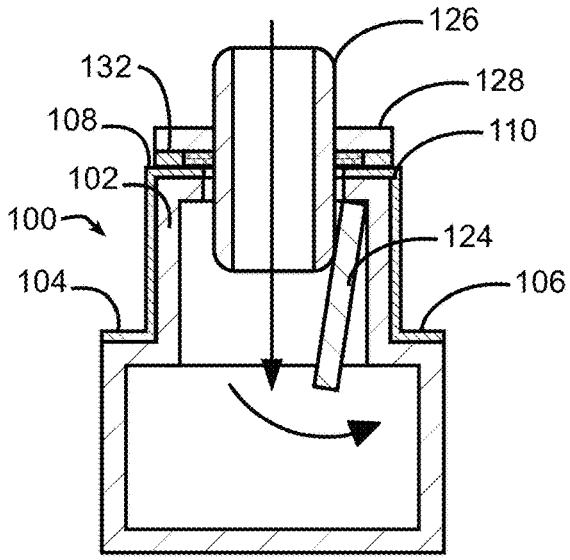
FIG. 11 is a cross-sectional view of the port from the rack manifold of FIG. 10, taken along lines 11-11 thereof.

FIGS. 10-11, for example, illustrate plug 112 of manifold 110 received in port 118, along with a plug or connector 126 of a spray device docked in a port 102. As seen in FIG. 10, a conductive path (in dashed lines) is established between wires 120, 122. In addition, as illustrated in FIG. 11, when plug 126 is seated into port 102, conductive ring 132 is in both mechanical and electrical contact with conductive pads 108, 110 to electrically coupled the conductive pads with one another. It should be noted that in this configuration, where multiple docking ports and dock detectors are used, the dock detectors are effectively coupled in parallel with one another such that docking of a spray device connector into any of the docking ports bridges the electrical conductors 104, 106.

It will be appreciated that docking detection may be implemented in other manners in other embodiments. For example, formation of an electrical contact through mating of a spray device plug and a port may be implemented in other manners, e.g., using various alternative dock detectors including electrical contacts disposed elsewhere on plug 126 and/or elsewhere in port 102. An innumerable number of electrical and mechanical connector approaches used for electrical connectors may also be used, e.g., using pins, pads, rings, plugs, etc.

Further, while conductive traces 104, 106 are illustrated on opposing sides of each port, conductive traces may be routed along the same side of each port. Conductive traces 104, 106 may be printed or deposited on, or integrally formed into manifold 100, e.g., using printing or comolding, and may be formed of various metals or other conductive materials. Conductive traces 104, 106 may also be implemented as wires mounted to manifold 100, e.g., using molded brackets, or may even be routed internally within a manifold. Conductive traces may also be molded within the sidewalls of the manifold to reduce exposure to potentially corrosive conditions in the wash tub. It will also be appreciated that various electrical contact or plug arrangements may be used in port 118 and plug 112 to interconnect pins 114, 116 with wires 120, 122.

It will be appreciated that in some embodiments, continuity, i.e., where an electrical circuit is completed when a spray device is docked and the circuit remains open when a spray device is not docked, may be sensed by controller 30 for docking detection. In other embodiments, however, other sensors may be used.

Figure 12:
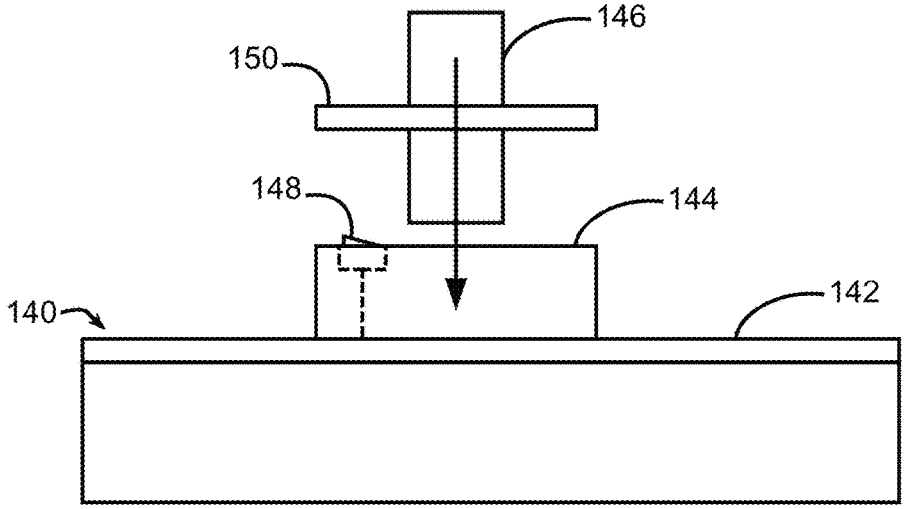
FIG. 12 is a side view of another example rack manifold and port implementation suitable for use in the dishwasher of FIG. 1, and using a contact switch for dock detection.

For example, a dock detector may include a mechanically-actuated contact switch in some implementations such that no conductive surface need be provided on a spray device connector. FIG. 12, for example, illustrates a section of a manifold 140, which includes a pair of electrical conductors (one of which is shown at 142) and a docking port 144 configured to receive a spray device connector 146. A dock detector 148 is configured as a contact switch which is switchable between open and closed states and includes internal contacts, at least one of which is displaced via mechanical depression of the switch to switch between the open and closed states. As illustrated in FIG. 12, for example, dock detector may be normally open and biased to project beyond a top surface of the port. Then, when spray device connector 146 is docked to docking port 144, a flange 150 depresses the switch to the closed state. Contacts of the dock detector 148 are electrically coupled to the pair of electrical conductors 142 such that when the switch is closed, the electrical conductors and electrically coupled to one another. It will be appreciated that normally-closed switches may be used in some embodiments, and other switch placements and configurations may be used, e.g., where the switch is disposed proximate an inner wall of a port to detect when the spray device connector is inserted into the port. In addition, in some implementations a switch may be integrated into a check valve such that movement of the check valve as a result of docking of a spray device connector closes or opens the switch.

Figure 13:
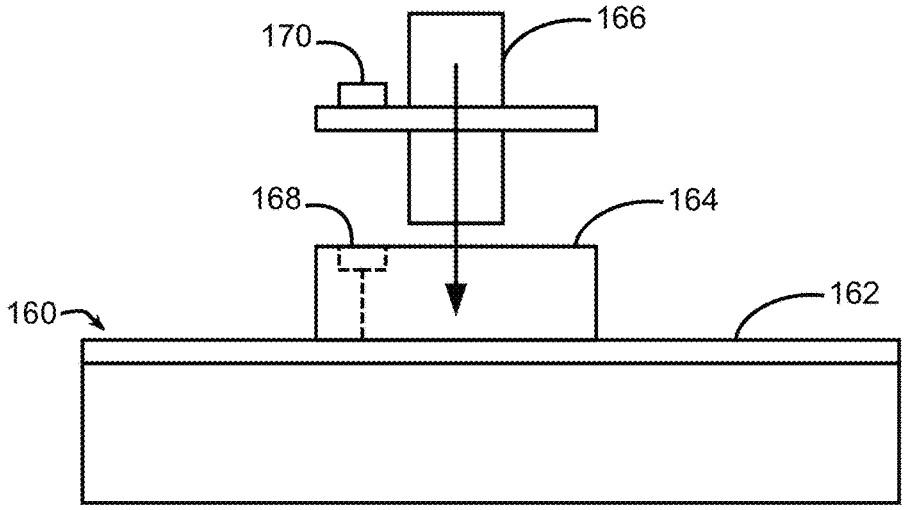
FIG. 13 is a side view of another example rack manifold and port implementation suitable for use in the dishwasher of FIG. 1, and using an electrical component on a spray device connector for dock detection.

As another example, other types of sensors may be used as dock detectors. FIG. 13, for example, illustrates a section of a manifold 160 including electrical conductors 162 and a docking port 164 configured to receive a spray device connector 166. In this implementation an electrical component 168 operates as a dock detector that is configured to detect the presence of spray device connector 166 by sensing some characteristic of the spray device connector, e.g., as may be provided by an element 170 disposed on the spray device connector and configured to be disposed proximate to the dock detector when the spray device connector is docked in the docking port. For example, a magnetic sensor or switch may be used in some embodiments, and element 170 may be a magnet that is attached to or embedded within specific location that resides over dock detector 168 when docked. The magnetic switch may have open and closed states and be normally open, and the magnetic field generated by the magnet on the spray device connector may be used to push or pull one or more of a pair of contacts of the switch closed during docking, and then allow the contacts to return to the open position when the spray device connector is removed.

In other embodiments, dock detector 168 may be a proximity sensor, e.g., using inductive, capacitive, magnetic, optical or photoelectric sensing to determine when a spray device connector is docked. In other embodiments a Hall Effect sensor may be used, where a magnet (e.g., on a spray device connector and a Hall Effect sensor on manifold or other location in the dishwasher may be used to determine when the spray device connector is docked. In still other embodiments, wireless sensing of an active or passive element on the spray device connector may be used, e.g., where dock detector 168 is a wireless sensor and element 170 is an RFID tag, passive wireless sensor tag (PWST), wireless tag or Bluetooth tag. In other embodiments, a pressure sensor coupled to a manifold may be used to detect a change in pressure or weight from a spray device when it is docked, and in other embodiments, a contact switch may be used such that a mechanical coupling of a spray device to a port depresses the switch and closes the contacts.

Furthermore, while some implementations (e.g., the implementation illustrated in FIGS. 8-11) are only capable of detecting that a spray device connector is coupled to any of the docking ports on a manifold, in other implementations each port docking port may be separately monitored such that controller 30 may determine which of the docking ports is coupled to a spray device connector. For example, separate sets of conductive traces and wires may be used for each docking port, or a common ground may be used for all docking ports with separate traces and wires dedicated to each docking port.

In other implementations, all docking ports may share the same traces and wires, but each docking port and/or spray device connector may include additional electrical circuitry to vary an electrical characteristic of a signal communicated by and/or sensed by controller 30 and thereby uniquely identify the associated docking port to the controller. For example, with reference again to FIG. 13, electrical component 168 and/or element 170 (which in this implementation also may be considered to be an electrical component) may be configured as active or passive components that vary resistance, inductance, capacitance, or another characteristic of an input signal communicated by controller 30. Further, in some implementations, component 168 or element 170 may be configured as an active or passive component (e.g., an active electrical circuit) capable of communicating analog or digital data (e.g., pulses) suitable for identifying that a spray device connector is coupled to the associated port. In addition, in some implementations a spray device connector may be configured to identify a spray device type for the spray device to which the spray device connector is mounted (e.g., using element 170 to vary some electrical characteristic or otherwise communicate an identifying signal identifying the associated spray device), thereby enabling a controller to determine what type of spray device (e.g., a silverware basket, a drinkware basket, a power wash sprayer, etc.) is docked to the manifold and to configure the wash cycle appropriately.

In addition, in some implementations, the signal output by controller 30 may be used as a source of power for a spray device coupled to a port, e.g., to energize a motor that drives movable components on the spray device, to control one or more diverter and/or shut-off valves that control the flow of fluid through the spray device, to power an electrical circuit, etc.

Figure 14:
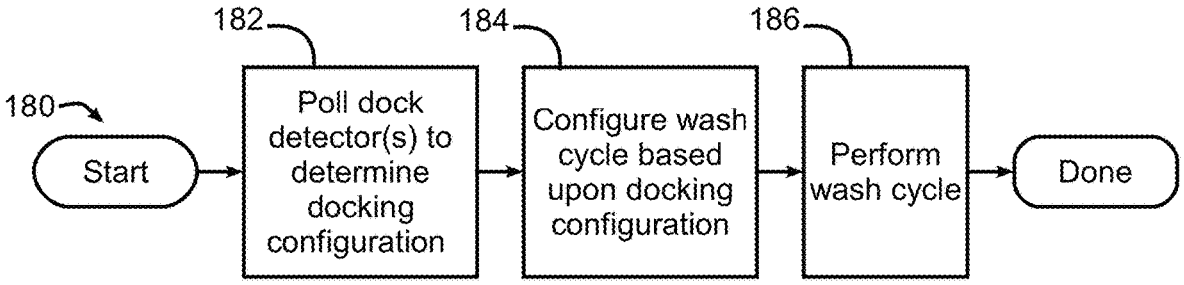
FIG. 14 is a flowchart illustrating an example wash cycle operation using docking detection and suitable for use in the dishwasher of FIG. 1.

Next turning to FIG. 14, a sequence of operations 180 is illustrated for performing a wash cycle using controller 30. At the initiation of a wash cycle (e.g., in response to user input), controller 30 may poll the dock detector(s) to determine a docking configuration for the dishwasher (block 182). The docking configuration may identify, for example, whether a spray device connector is docked to any of the docking ports, to which docking port(s) one or more spray device connectors are docked and/or the types of spray devices docked to one or more docking ports. Next, in block 184 the controller may configure the wash cycle based upon the docking configuration, and in block 186 the controller may perform the wash cycle. In block 184 and/186, controller 30 may control one or more wash cycle parameters, e.g., a wash segment time, a wash cycle time, a fluid pressure, a fluid amount, a fluid temperature, a diverter valve setting, a control valve setting, etc. based upon the determined docking configuration. For example, in one implementation, controller 30 may selectively direct a flow of fluid to a manifold (e.g., by controlling a diverter or other valve) during certain segments of a wash cycle based upon whether a spray device connector has been detected as being docked to any of the docking ports on the manifold.

Other modifications will be made in other implementations, and will be apparent to those of ordinary skill having the benefit of the instant disclosure.

Spray Container Modular Docking

Figure 15:
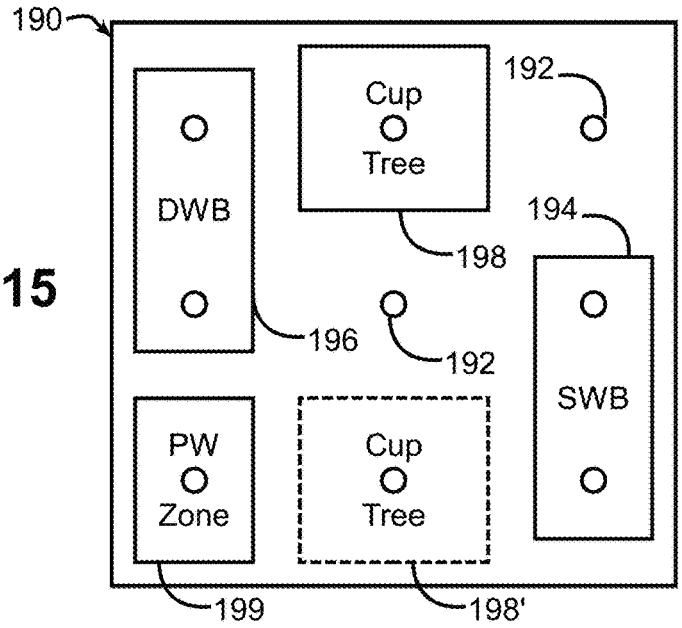
FIG. 15 is a functional top plan view of the rack of FIG. 3, illustrating example docking locations for a plurality of spray containers.

Now turning to FIG. 15, it will be appreciated that the aforementioned modular docking system may be used to customize a dishwasher for various washing tasks using various types of spray devices in different potential docking locations, e.g., in different potential docking locations on one or more racks. FIG. 15, in particular, illustrates an example rack 190 including a 3×3 array of ports 192 that define various docking locations on the rack, and suitable for supporting various types of spray devices, e.g., spray devices 194-199. For simplification, both the manifold and the rack tines common to many rack designs have been omitted from FIG. 15. It will be appreciated, however, that various single or multiple manifold designs may be used, and that various tine arrangements, including various fixed and/or movable arrangements of tines, may be incorporated into rack 190. Further, as noted above, manifolds and/or docking ports may be disposed elsewhere from a rack in some embodiments, and as such, spray containers may be docked in other locations in a dishwasher in some embodiments, e.g., to a wall, floor, or ceiling of a wash tub and/or to a door of the dishwasher.

A spray device, in this regard, may be considered to include any device including a fluid inlet and one or more nozzles or outlets capable of directing a fluid, e.g., water and/or water mixed with detergent, rinse agent and/or other additive within the tub of a dishwasher. A spray device may include fixed nozzles, adjustable nozzles, movable nozzles (e.g., spinning or oscillating nozzles, as well as nozzles powered by hydraulic pressure and/or nozzles driven by electrical actuators), and combinations thereof. As will become more apparent below, in some embodiments some or all spray devices used in connection with a modular docking system may be configured as spray containers. A spray container may be considered to be a spray device that includes a container body configured to contain, house or otherwise retain one or more types of utensils, as well as one or more nozzles configured to direct a spray of fluid against those utensils during a wash cycle. Spray containers may include various types of utensil containers that include one or more integrated sprayers, including, for example, containers for silverware, cutlery, bottles, cups, stemware, etc. In addition, some spray containers may be considered to be spray baskets, in that such containers have the form factor of a basket with one or more compartments defined by a bottom wall and one or more sidewalls for receiving utensils within each of the compartments.

Each spray device, spray container, or spray basket may be dockable to one or more ports, and in some instances, may receive fluid from a manifold through multiple ports. In some embodiments, however, only one port may be actively coupled to a given spray device, spray container, or spray basket, and additional mechanical couplings, either associated with or separate from a port, may also be used to provide further mechanical support thereto. In some embodiments, for example, a mechanical coupler may be disposed on a spray device, spray container or spray basket and separated from a connector by the same spacing as is provided between docking ports such that when the connector mates with one docking port to provide a mechanical and fluid connection between the manifold and the spray device, spray container or spray basket, the additional mechanical coupler mechanically couples with a second docking port without unsealing or otherwise activating the second docking port.

One such type of spray device is a silverware basket (SWB) 194, which is generally used to contain silverware, cutlery and similar articles, and which includes one or more nozzles configured to direct a spray of fluid against contained utensils during a wash cycle. Example implementations of a silverware basket are discussed below in connection with FIGS. 16-19. Another such type of spray device is a drinkware basket (DWB) 196, which may be generally used to contain various types of drinkware or other liquid containers, including cups, glasses, stemware, baby bottles, etc., and which includes one or more nozzles configured to direct a spray of fluid at least within an interior portion of a contained article during a wash cycle. Example implementations of a drinkware basket are discussed below in connection with FIGS. 22-25. Yet another type of spray device is a cup tree 198, which includes one or more levels of "branches" including integrated nozzles to both support cups, glasses, stemware and/or bottles and direct a spray of liquid at least within interior portions thereof. Example implementations of a cup tree are discussed below in connection with FIGS. 20-21.

In addition to spray baskets and other types of spray containers, a modular docking system may also support additional spray devices, e.g., to direct a spray of fluid within a particular area of a rack and against utensils disposed in that area, e.g., as represented by power wash (PW) zone 199. Such zones may be useful, for example, to provide more thorough cleaning of pots, pans, dishes, etc. placed in the zones. Additional spray devices, e.g., bottle washing spray devices, among others, may also be incorporated into a modular docking system in some embodiments.

It will also be appreciated that while in some embodiments certain spray devices may be restricted to certain locations or ports, in other embodiments it may be desirable to enable different spray devices to be docked in different positions and/or orientations, thereby providing a consumer with a wide variety of options for customizing a rack for different types of loads. As but one example, FIG. 15 illustrates at 198' an alternate position for cup tree 198. It will also be appreciated that spray devices may be removed from a rack when not needed to provide additional capacity for other types of utensils.

Further details regarding various specific types of spray devices suitable for use with a modular docking system are described in greater detail below. However, it will be appreciated that a modular docking system may be used with other combinations and/or types of spray devices, spray containers and/or spray baskets in other embodiments, so the invention is not limited to the specific implementations discussed herein.

Silverware Basket with Integrated Interior Sprayer

One type of spray device suitable for use with the aforementioned modular docking system, as well as in other dishwasher designs not incorporating modular docking, is a silverware basket. In some embodiments, and as illustrated, for example, in FIG. 16, a silverware basket 200 may include a container body 202 including multiple side walls 204 (e.g., four side walls), a bottom wall 206, and one or more interior walls 208 (e.g., three interior walls), which collectively define one or more compartments 210 (e.g., six compartments) for retaining utensils. Additional components, e.g., one or more handles 212, may also be disposed on the silverware basket 200. Silverware basket 200 may be formed of injection molded plastic, coated metal wire, or using other constructions known to those of ordinary skill having the benefit of the instant disclosure. Further, it will be appreciated that any number of compartments, including a single compartment, may be provided in a silverware basket in other implementations, so the invention is not limited to the particular configurations illustrated herein.

Silverware basket additionally includes one or more integrated interior sprayers 214 (e.g., two laterally separated interior sprayers) disposed within an interior of container body 202 and inwardly from side walls 204. Side walls 204, in particular, may be considered to define a perimeter P of container body 202, and it may be seen that each interior sprayer 214 is positioned inward from the perimeter.

Figure 17:
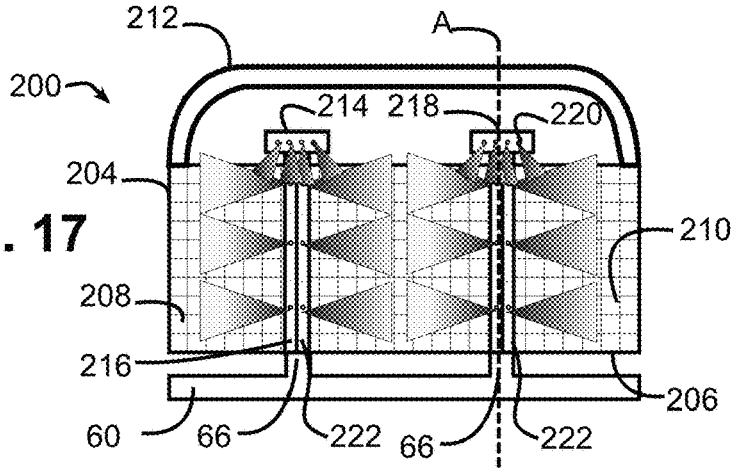
FIG. 17 is a side cross-sectional view of the silverware basket of FIG. 16, taken along lines 17-17 thereof.

Each interior sprayer 214 may include a spray tower 216 and an overhead sprayer 218 disposed proximate a top end of the interior sprayer, as well as a plurality of nozzles 220 and an inlet 222 in fluid communication with nozzles 220. As illustrated in FIG. 17, each inlet 222 may be docked to a docking port 66 of manifold 60, e.g., in the various manners described above. In some implementations, spray tower 216 may extend generally perpendicular to bottom wall 206, e.g., along a substantially vertical axis A, and one or more sets of nozzles 220 may be arranged and separated from one another axis A to direct sprays of fluid at different elevations from bottom wall 206, and thereby direct fluid against utensils retained within each compartment. In addition, nozzles 220 may be provided on each overhead sprayer 218, and with overhead sprayer disposed above a compartment, a spray of fluid may be directed downwardly into the compartment from a higher elevation from side walls 204.

In some embodiments, interior sprayer 214 may include only fixed nozzles, while in other embodiments, one or more nozzles may be movable, e.g., in response to fluid pressure or activation of an electrical actuator. For example, in some embodiments, overhead sprayer 218 may be configured to spin or oscillate in response to fluid pressure in interior sprayer 214. As such, each interior sprayer 214 directs at least one spray of fluid into a compartment 210 of silverware basket 200 from a position interior of the perimeter P of the silverware basket.

Figure 16:
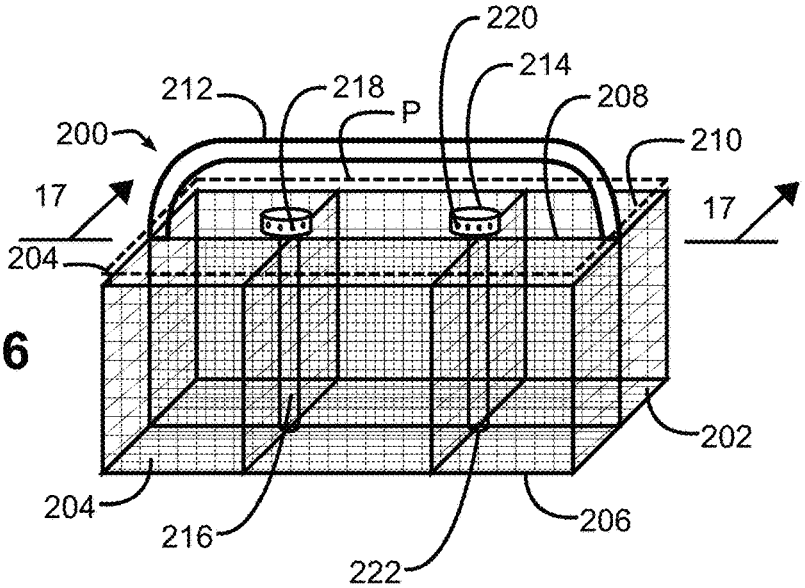
FIG. 16 is a perspective view of a silverware basket with integrated sprayer suitable for use in the dishwasher of FIG. 1.

It will be appreciated that various modifications may be made to silverware basket 200 in other embodiments. For example, it will be appreciated that one or more fluid conduits may be incorporated into a silverware basket to communicate fluid between one or more inlets and one or more nozzles. In some embodiments, for example, a single inlet may be used, and may be coupled to multiple interior sprayers through appropriate fluid conduits. In addition, different numbers and positions of interior sprayers may be used in other embodiments. As shown in FIGS. 16 and 17, interior sprayers 214 are disposed at intersections between pairs of mutually orthogonal interior walls 208; however, in other embodiments, interior sprayers 214 may be disposed along interior walls 208, or may be physically separated from any interior walls. Further, in some embodiments, at least portions of interior sprayers 214 and/or various fluid conduits in fluid communication therewith may be integrated into an interior wall 208, e.g., integrally molded therein. Fluid conduits may also be integrally molded into other portions of a silverware basket, e.g., within a side wall or bottom wall thereof.

Figure 18:
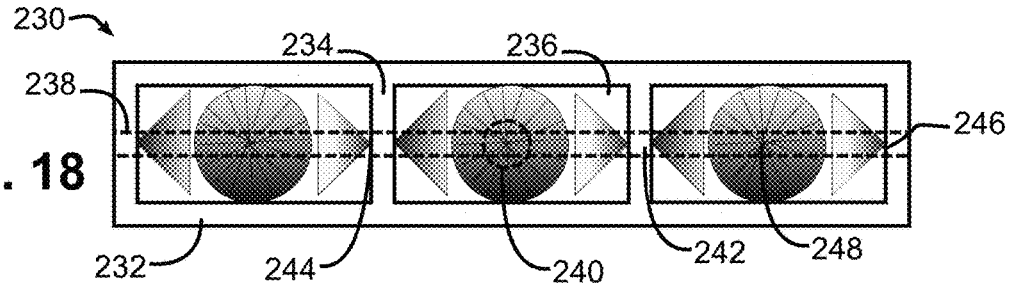
FIG. 18 is a top plan view of another silverware basket with integrated sprayer suitable for use in the dishwasher of FIG. 1.

FIG. 18, for example, illustrates another silverware basket 230 including four side walls 232 and two interior walls 234 defining three compartments 236, as well as an overhead handle 238, with each of side walls 232, interior walls 234 and handle 238 including integrally formed fluid conduits coupled to a single fluid inlet 240. Two interior sprayers 242 including nozzles 244 are integrated into interior walls 234 to direct sprays of fluid into opposite compartments 236, while additional nozzles 246 in side walls 232 also direct sprays of fluids into the compartments. In this implementation, an overhead sprayer 248 is integrated into handle 238 to direct sprays of fluid downwardly into each compartment.

Figure 19:
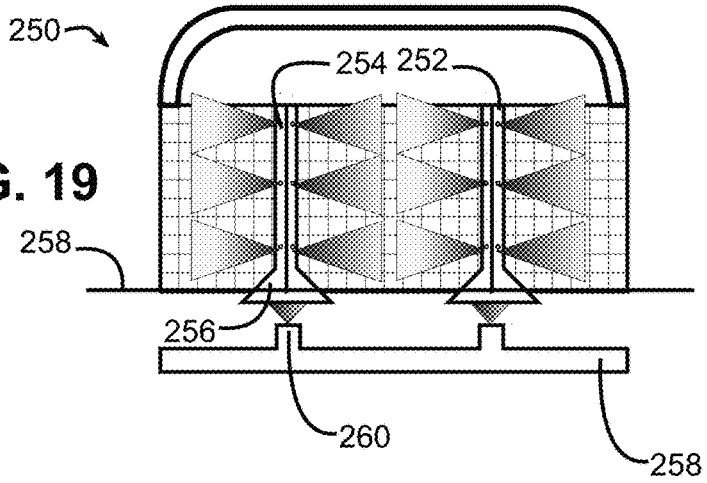
FIG. 19 is a side cross-sectional view of another silverware basket with integrated sprayer suitable for use in the dishwasher of FIG. 1.

A silverware basket with integrated interior sprayers may also be supplied with fluid in other manners in other embodiments. For example, FIG. 19 illustrates a silverware basket 250 including a pair of interior sprayers 252 including nozzles 254 in fluid communication with a pair of fluid inlets configured as fluid collectors 256, which in some embodiments may be funnel shaped. Silverware basket 258 is configured to be mechanically coupled to or otherwise placed and supported within a rack 258; however, no mechanical coupling may be used between the fluid inlets and a fluid supply. In this embodiment, a manifold 258, which may be integrated into rack 258 or simply positioned within a wash tub at an appropriate location, may include one or more fluid outlets 260 configured to direct fluid into aligned fluid collectors 256, such that the fluid collectors are in a spaced apart relationship relative to the fluid outlets, but still configured to receive a supply of fluid therefrom.

It will also be appreciated that, each of the silverware basket designs illustrated in FIGS. 16-19, the inlet of the silverware basket extends in a direction generally perpendicular to a bottom wall of the container body such that insertion of the silverware basket into the rack in a direction generally perpendicular to the bottom wall of the container body effectively forms a fluid connection between the inlet and the manifold (either by docking in a docking port or otherwise positioning a fluid collector over an associated fluid outlet of a manifold). In other embodiments, however, a fluid inlet of a silverware basket may be disposed in other orientations or other locations on a silverware basket.

Other modifications will be made in other implementations, and will be apparent to those of ordinary skill having the benefit of the instant disclosure.

Cup Tree with Integrated Sprayer

Another type of spray device that may be used with the aforementioned modular docking system, as well as in other dishwasher designs not incorporating modular docking, is a cup tree. In some embodiments, and as illustrated, for example, in FIG. 20, a cup tree 270 may include a vertical member or trunk 272 including a plurality of branches 274 extending therefrom for supporting various types of drinkware articles and other liquid containers, including cups, glasses, stemware, baby bottles, etc., e.g., cups 276. Vertical member 272 extends generally vertically when cup tree 270 is disposed in a dishwasher, branches 274 generally include a plurality of nozzles 278 configured to direct a spray of fluid onto an interior surface of a supported drinkware article, and the branches 274 and vertical member 272 include integrated fluid conduits to place nozzles 278 in fluid communication with one or more inlets 280. In some embodiments, nozzles 278 may include side nozzles that direct a spray of fluid toward a side wall of a drinkware article and end nozzles that direct a spray of fluid toward a bottom of a drinkware article, although other nozzle arrangements are contemplated.

Branches 274 are generally configured to support a cup 276 or other drinkware article, and in some embodiments may include one or more drinkware supports 282 for supporting a cup or article in a spaced apart relationship from nozzles 278 such that greater spray coverage of the interior surface of the article may be obtained. Drinkware supports may include, for example, one or more sub-branches or spokes that extend at an acute angle relative to a branch.

Each branch may be configured to extend at an upward acute angle relative to the vertical member, e.g., about 45 degrees, although other angles may be used in other embodiments. Each inlet 280 may be docked to a docking port of a manifold, e.g., in the various manners described above, although in some implementations a fluid collector similar to that illustrated in FIG. 19 may be used.

Figure 20:
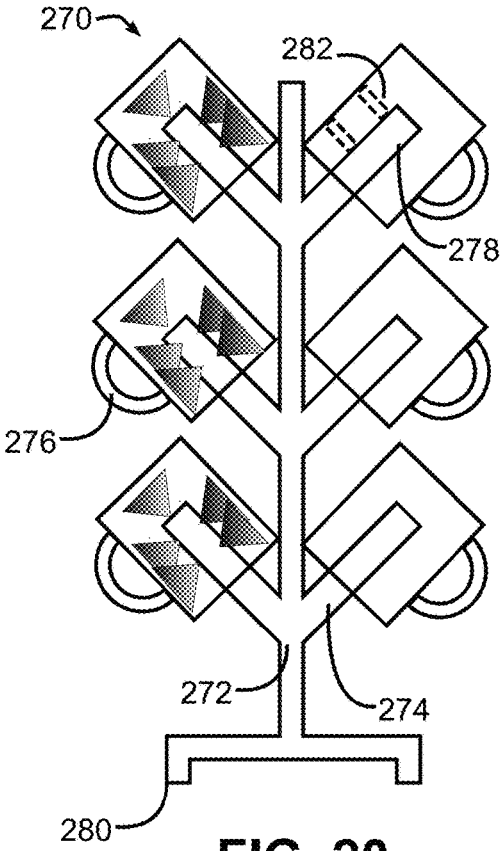
FIG. 20 is a functional side elevational view of a multi-level cup tree with integrated sprayer suitable for use in the dishwasher of FIG. 1.
Figure 21:
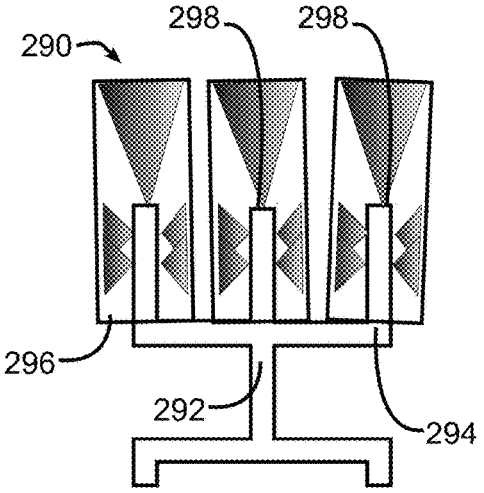
FIG. 21 is a functional side elevational view of a single-level cup tree with integrated sprayer suitable for use in the dishwasher of FIG. 1.
Figure 22:
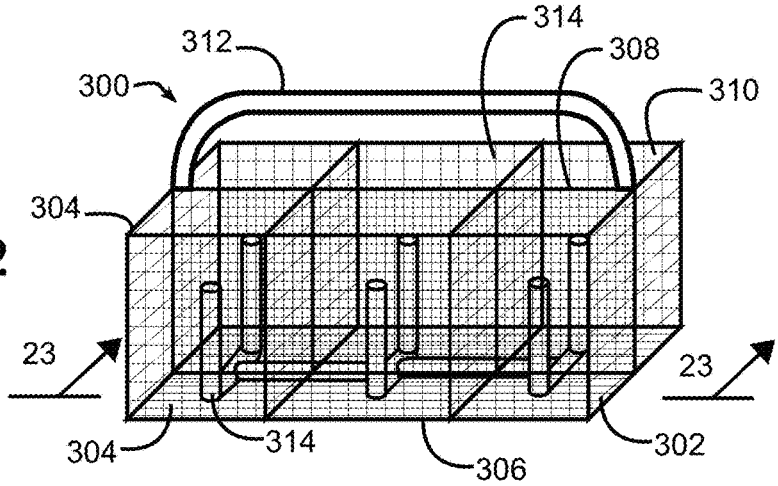
FIG. 22 is a perspective view of another spray container suitable for use in the dishwasher of FIG. 1.

It will be appreciated that different numbers and arrangements of nozzles may be used in different embodiments, and that some of the nozzles may be movable (e.g., disposed on spinning or oscillating bodies). Further, in some embodiments, branches 274 may be disposed at multiple elevations on vertical member 272, e.g., three elevations as shown in FIG. 20, such that multiple levels of drinkware articles may be supported. In other implementations, however, e.g., as illustrated by cup tree 290 of FIG. 21, a vertical member or trunk 292 may include only a single elevation of branches 294 supporting a single level of drinkware articles 296. In addition, while in some embodiments nozzles may only be provided on branches, in cup tree 290 nozzles 298 are disposed both on the branches 294 and vertical member 292 such that a drinkware article 296 may also be supported by the vertical member. Further, in contrast to cup tree 270, where branches 274 are linear and extend upwardly at an acute angle relative to vertical member 272, branches 294 are "L-shaped" and extend substantially perpendicular to vertical member 292. Thus, it will be appreciated that branches may take a number of forms, including one or more segments that are curved, straight, or include other profiles.

It will be appreciated that each elevation of branches may include different numbers of branches in different embodiments, e.g., two, three, four, etc. branches radially arranged (e.g., 90, 120, 180 degrees, etc.) about the trunk. Some designs may also include multiple vertical members or trunks, and different inlet configurations, including a single inlet, may also be used. The angles of branches may also vary in different embodiments, and while some embodiments may use the same sizes, angles and/or orientations for all branches, in other embodiments different branches may be configured for particular types of drinkware articles.

Other modifications will be made in other implementations, and will be apparent to those of ordinary skill having the benefit of the instant disclosure.

Drinkware Basket with Integrated Sprayer

Yet another type of spray device suitable for use with the aforementioned modular docking system, as well as in other dishwasher designs not incorporating modular docking, is a drinkware basket. In some embodiments, and as illustrated, for example, in FIG. 22, a drinkware basket 300 may include a container body 302 including multiple side walls 304 (e.g., four side walls), a bottom wall 306, and one or more interior walls 308 (e.g., three interior walls), which collectively define one or more compartments 310 (e.g., six compartments) for retaining drinkware articles and other liquid containers, including cups, glasses, stemware, baby bottles, etc. Additional components, e.g., one or more handles 312, may also be disposed on the drinkware basket 300. Drinkware basket 300 may be formed of injection molded plastic, coated metal wire, or using other constructions known to those of ordinary skill having the benefit of the instant disclosure. Further, it will be appreciated that any number of compartments, including a single compartment, may be provided in a drinkware basket in other implementations, so the invention is not limited to the particular configurations illustrated herein.

Figure 23:
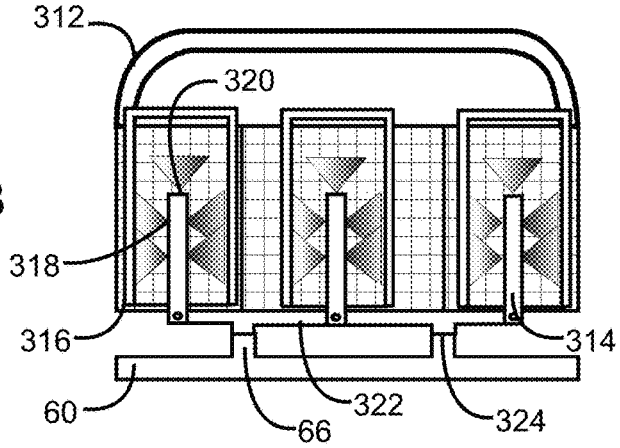
FIG. 23 is a side cross-sectional view of the spray container of FIG. 1.

Drinkware basket additionally includes one or more integrated spray members 314 (e.g., six sprayer members, one for each compartment) disposed within an interior of container body 302 and inwardly from side walls 304. With further reference to FIG. 23, each spray member 314 is configured to project upwardly into a drinkware article, e.g., drinkware article 316, when drinkware article 316 is placed upside down in the respective compartment 310, and each spray member 314 includes a plurality of nozzles, e.g., a plurality of side nozzles 318 configured to direct a spray of fluid toward a side wall of drinkware article 316 and one or more end nozzles 320 configured to direct a spray of fluid toward a bottom of the drinkware article. It will be appreciated that generally a spray member is spaced apart from each side wall 304 and interior wall 308 such that a drinkware article may be placed over the spray member in an upside down orientation, and the drinkware article will thus be retained within the associated compartment during a wash cycle.

Each spray member 314 is in fluid communication with one or more fluid conduits 322 that are in turn in fluid communication with an inlet 324. Each inlet 324 may be docked to a docking port 66 of manifold 60, e.g., in the various manners described above, or as with silverware basket 250 of FIG. 19, a fluid collector may be used instead of a connector to a docking port. In addition, a single inlet may be used in some embodiments, and it will be appreciated that at least portions of spray members 314 and/or various fluid conduits in fluid communication therewith may be integrated into container body 302. Further, in some embodiments, spray member 314 may include only fixed nozzles, while in other embodiments, one or more nozzles may be movable, e.g., in response to fluid pressure or activation of an electrical actuator.

Figure 24:
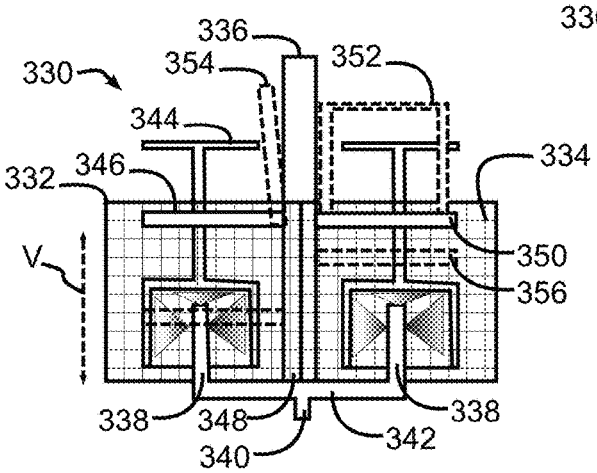
FIG. 24 is an end cross-sectional view of another spray container suitable for use in the dishwasher of FIG. 1, and including an adjustable stemware holder.
Figure 25:
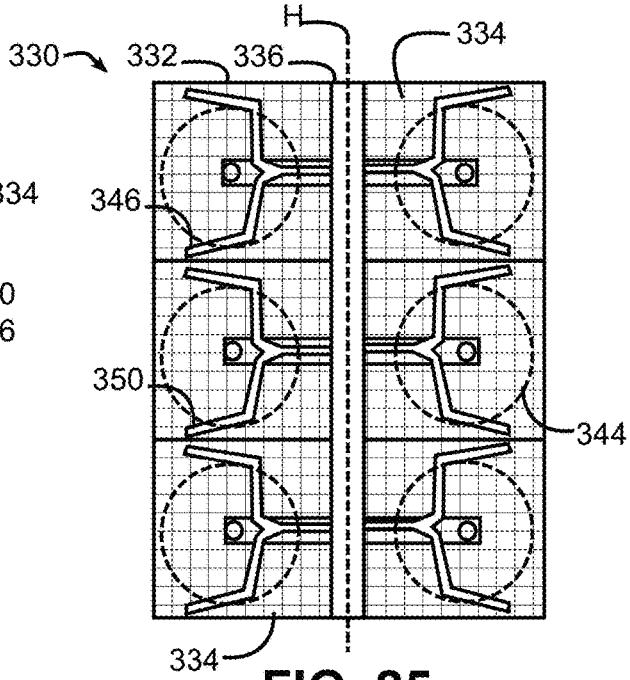
FIG. 25 is a top plan view of the spray container of FIG. 24.

In some embodiments, a drinkware basket may also include an integrated stemware support for use in stabilizing stemware (e.g., wine glasses, goblets, etc.) when retained within a compartment of a drinkware basket. FIGS. 24 and 25, for example, illustrate a drinkware basket 330 including a container body 332 including one or more sidewalls and/or one or more interior walls defining multiple (e.g., six) compartments 334, as well as a handle 336 and individual spray members 338 for each compartment that are in fluid communication with an inlet 340 through a plurality of fluid conduits 342.

To support drinkware articles such as stemware 344 within each compartment 334, a stemware support 346 is provided for each compartment 334 of drinkware basket 330. Each stemware support 346 includes a vertical support member 348 supporting a drinkware support member 350 that is selectively positionable over or within the associated compartment, and is shaped and configured to abut and otherwise support the stem of a stemware article such as a wine glass, e.g., having a generally Y-shape as illustrated in FIG. 25, and optionally further including an indentation sized and configured proximate the stem of the stemware article to abut the stem and thereby restrict movement of the stemware article during a wash cycle. In addition, in some implementations, the drinkware support member 350 may be further configured to function as a cup shelf and support a second drinkware article, e.g., a cup 352, above any drinkware article retained in the associated compartment 334, thereby enabling two rows of drinkware articles to be retained by the drinkware basket if desired.

In addition, it is desirable in some embodiments to provide various adjustments to a stemware support. In some embodiments, for example, it may be desirable to enable drinkware support member 350 to pivot about a substantially horizontal axis such as axis H of FIG. 25, and between an engaged position as is shown in FIG. 24 for drinkware support member 350 and an unengaged position as represented at 354. The unengaged position may be used for loading/unloading or generally when non-stemware articles are retained in the drinkware basket. In addition, in some embodiments it may be desirable to enable drinkware support member 350 to be movable vertically (e.g., along a substantially vertical axis V as illustrated in FIG. 24) and thereby adjust the elevation of the drinkware support member relative to the associated compartment to accommodate different sizes of stemware and/or other drinkware articles and/or to configure the drinkware basket to efficiently retain two rows of cups. Stemware supports 346 may be vertically adjustable individually in some embodiments, while in other embodiments the stemware supports 346 may be adjustable as a group or in sub-groups (e.g., on each side of handle 336).

The adjustable range for a drinkware support member may include either predefined stop points or may be variable within a vertical range. In one example embodiment a user may be able to select which height location they prefer and then manually adjust the drinkware support member up or down utilizing shelf hooks, latches or other suitable attachments (e.g., dovetail detents, pegs and detents, hooks and stays, spring-loaded pins or ratchets, etc.) that connect to a separate receiver device (e.g., disposed on vertical support member 348). In another embodiment, a variable range may be used to define the height or length of a guide device, such as a rail, with a spring-loaded or other manually-releasable attachment.

A stemware support may implement adjustability by requiring a drinkware support member to be removed from one position in the vertical member and then reinserted into a different position or by having an actuating mechanism that will release and catch the drinkware support member at different vertical positions. The actuating mechanism may be implemented in some embodiments, for example, using a spring-loaded tab that must be depressed prior to moving vertically, tabs that rotate out of the vertical support prior to moving vertically, cam locks that are swiveled to release or engage at the desired vertical locations, etc.

Particularly when used with delicate drinkware articles such as stemware, some embodiments of a drinkware basket may provide a number of benefits, as a drinkware basket may retain and protect drinkware articles within individual compartments while providing dedicated jets within the basket that can gently wash/rinse each article. Additionally, a drinkware basket may be loaded prior to placing the basket in the dishwasher, which can make it easier to load and support multiple delicate drinkware articles in a compact region without having them bang together during loading or washing. Unloading may also be improved since the articles are contained within the separate basket and can all be removed from the dishwasher at once. Also, as the drinkware basket is connected to a dedicated fluid supply, the spray of fluid may be regulated or tuned to the specific needs of washing drinkware versus just being part of the total hydraulic washing action within the dishwasher.

Spray Basket with External Power Wash Zone

Still another type of spray device suitable for use with the aforementioned modular docking system, as well as in other dishwasher designs not incorporating modular docking, is a spray basket with external power wash zone. In some embodiments, and as illustrated, for example, in FIGS. 26-28, a spray basket 400 may include a container body 402 including multiple side walls 404 (e.g., four side walls) and a bottom wall 406. In some embodiments, one or more interior walls (not shown in FIGS. 26-28) may also be used to separate the container body into multiple compartments, although multiple compartments are not required in some embodiments. In fact, a single compartment 408 is incorporated into spray basket 400. Spray basket 400 may be configured in some embodiments as a silverware basket or a drinkware basket, or may otherwise be configured for various types of utensils. A handle 410 may also be provided in some embodiments.

As with the aforementioned silverware and drinkware baskets incorporating integrated sprayers, spray basket 400 includes one or more spray members configured to direct sprays of fluid within the compartment(s) 408 of the spray basket. For example, in the implementation illustrated in FIGS. 26-28, spray basket 400 may include one or more (e.g., three) vertically-oriented spray members 412 with one or more (e.g., three) overhead sprayers 414, and with a plurality of nozzles 416 distributed among the various spray members 412 and overhead sprayers 414, and with one or more fluid conduits 418 placing spray members 412 and overhead sprayers 414 in fluid communication with an inlet 420. As with the other spray device designs discussed above, nozzles may be fixed, oscillating, rotating, etc., and may be distributed in various fashions to direct sprays at retained utensils in various manners. In addition, spray members/sprayers may be integrated into walls, and additional nozzles may be disposed in side walls, in handle 410, etc., as desired. Further, where the spray basket is a drinkware basket, spray members similar to spray members 314 of FIGS. 22-23 may be used to direct a spray against an interior surface of an upside down drinkware article. As such, it will be appreciated that the particular configuration of compartment-directed sprayers/nozzles (hereinafter referred to as "container sprayers") is merely an example, and the invention is not limited to the particular configuration shown. In addition, inlet 420 may be docked to a docking port of a manifold (not shown), e.g., in the various manners described above, or as with silverware basket 250 of FIG. 19, a fluid collector may be used instead of a connector to a docking port.

Unlike the previously-discussed silverware and drinkware baskets, however, spray basket 400 additionally includes one or more external sprayers 422, e.g., power wash sprayers, each including one or more nozzles 424 configured to direct a spray of fluid externally from the spray basket, i.e., toward a utensil or area of a dishwasher that is external to, and typically adjacent to, container body 402 when the container body is disposed in a rack. Thus, spray basket 400 defines, on the various container sprayers, a first set of nozzles configured to direct a spray of fluid into the compartment(s) of the spray basket, and on the various external sprayers, a second set of nozzles configured to direct a spray of fluid external from the container body. As with container sprayers, external sprayers can vary in number, position, orientation, and spray pattern, and may, in some embodiments, include spinning and/or oscillating sprayers in addition to or in lieu of fixed nozzles. In addition, external sprayers 422 as illustrated in the figures may be disposed on a side wall of container body 402, e.g., mounted thereto or integrally formed therewith, although other locations and configurations may be used in other embodiments.

In some embodiments, external sprayers 422 may share direct and unimpeded fluid conduits with the container sprayers such that the same fluid supply provided at inlet 420 is used to simultaneously supply both the external sprayers 422 and container sprayers. It will be appreciated that through appropriate design of the nozzles, sprayers and/or fluid conduits, the relative rates of flow to the container and external sprayers may be controlled if desired. Further, in some embodiments, separate inlets may be used to supply the external and container sprayers respectively.

Figure 26:
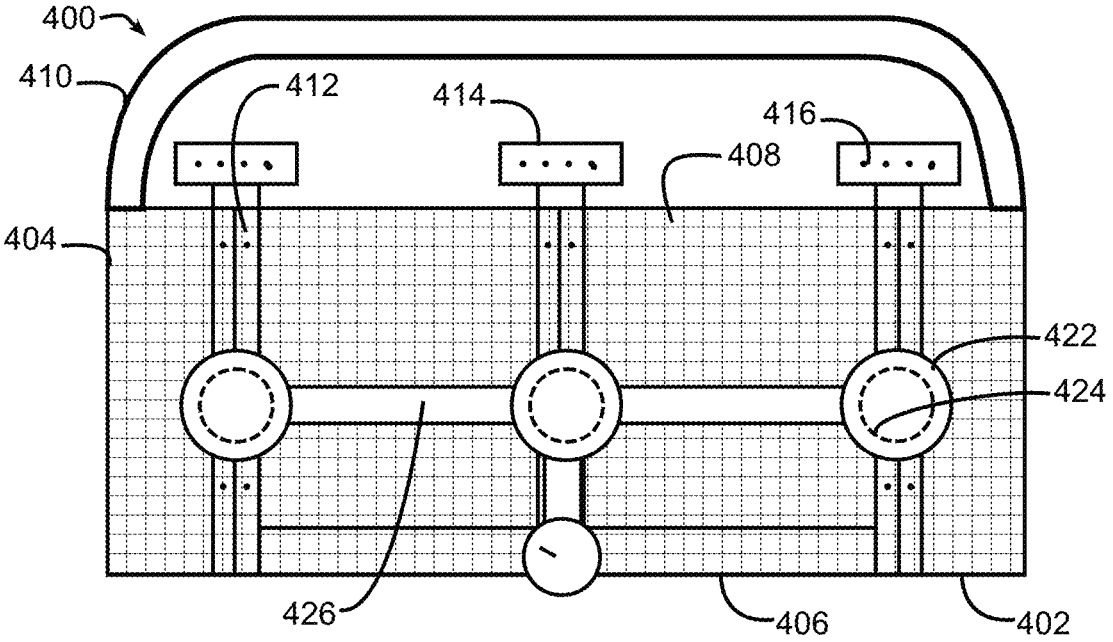
FIG. 26 is a side cross-sectional view of a spray container with integrated external power wash nozzles suitable for use in the dishwasher of FIG. 1.
Figure 27:
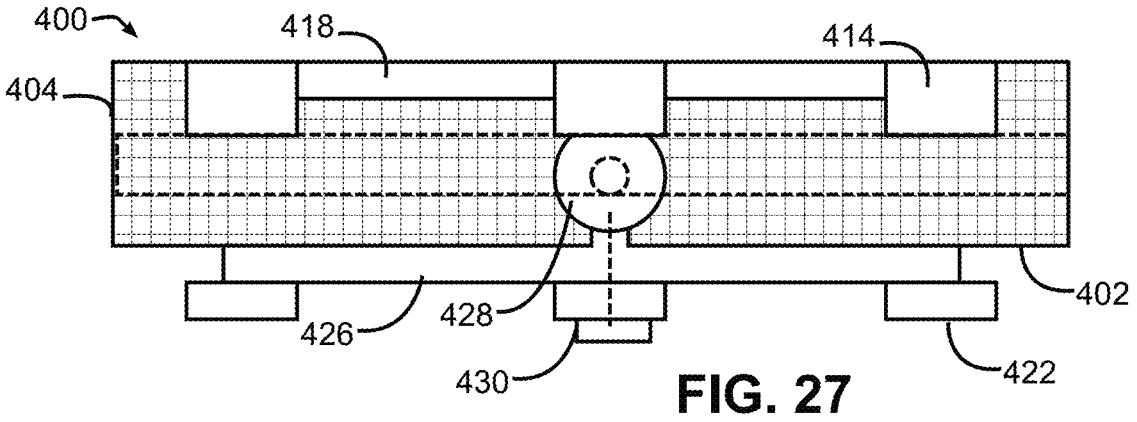
FIG. 27 is a top plan view of the spray container of FIG. 26.
Figure 28:
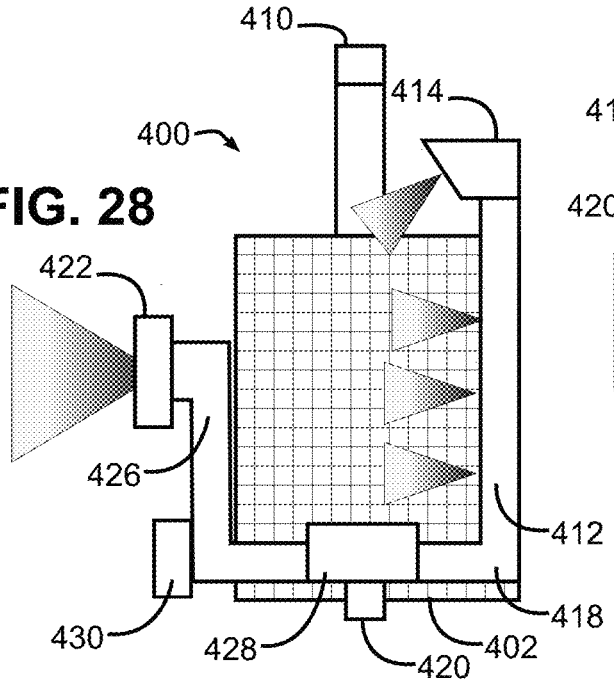
FIG. 28 is an end cross-sectional view of the spray container of FIG. 26.
Figure 29:
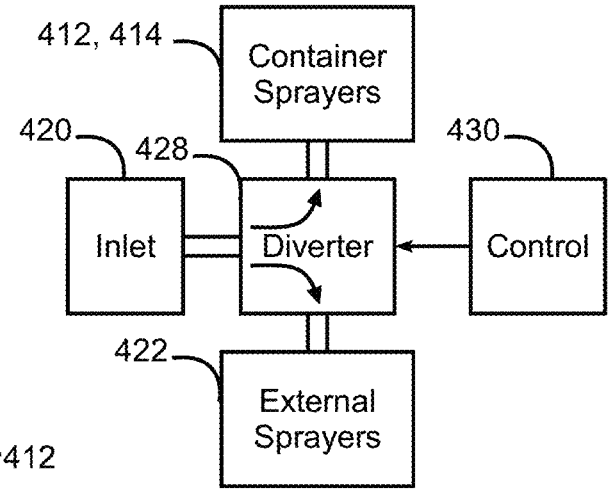
FIG. 29 is a block diagram of the fluid conducting components of the spray container of FIG. 26.

In other embodiments, however, and as illustrated in FIGS. 26-28, and with further reference to FIG. 29, it may be desirable to incorporate a fluid supply control mechanism in spray basket 400 to selectively route fluid to at least one of the external sprayers and the container sprayers. In the illustrated embodiment, separate fluid conduits 426 are used to route fluid to external sprayers 422, and the fluid supply control mechanism includes a diverter valve 428 interposed between inlet 420 and each of fluid conduits 418 and 426 to control the flow of fluid from inlet 420 to external sprayers 422 and the container sprayers. Diverter valve 428 in some embodiments may be configured to operate in only two discrete states or positions and thereby switch between a first state where the external sprayers are fully isolated from the inlet and all flow is directed to the container sprayers, and a second state where the container sprayers are fully isolated from the inlet and all flow is directed to the external sprayers. In other embodiments, however, diverter valve 428 may include an additional discrete state or position that routes fluid to both the external sprayers and the container sprayers (e.g., positions or states for external only, container only, and external and container combined).

In still other embodiments, diverter valve 428 may be configurable among a range of positions or states to meter or vary the amount of flow to each of the external sprayers and the container sprayers (e.g., to route 30% of flow to the external sprayers and 70% of flow to the container sprayers. In still other embodiments, diverter valve may be implemented by alternate valve arrangements, e.g., using a single shut-off or diverter valve to control flow to one of the external/container sprayers while using direct and unimpeded flow path between the other of the external/container sprayers and the inlet, using separate diverter or shut-off valves for each of the external/container sprayers, separately controlling each container sprayer and/or external sprayer, etc. In addition, in some embodiments, multiple sets of external sprayers may be used and in some instances may be separately controllable from one another, e.g., to provide multiple external spray zones on either side of a spray basket and/or on one or more ends of a spray basket.

A fluid supply control mechanism may also include various actuation mechanisms to control a diverter valve, shut-off valve or other flow restriction device. For example, control of diverter valve 428 or any of the other valve arrangements discussed above may be implemented using a user actuatable mechanical control 430, which in some embodiments may be a knob, a lever, a switch, or other suitable mechanism. Control 430 in the implementation of FIGS. 26-28, for example, is a knob that is linked to diverter valve 428 such that rotation of the knob by a user meters relative flow between the external and container sprayers, or in the alternative, has two positions that route all flow to either external sprayers or container sprayers, or in another alternative, also has a third, intermediate position that routes flow to both external and container sprayers. Control 430 as illustrated is along a side wall of container body 402, although other positions for control 430 may be positioned in different locations on a spray basket in other embodiments, e.g., on handle 410 or otherwise on a top side of the spray basket 400 to facilitate access when the spray basket is docked on a lower rack of the dishwasher.

In some embodiments, control 430 may be manually controllable by a user prior to the start of a wash cycle, while in other embodiments, control 430 may be controlled by controller 30 to vary the operation of spray basket 400 at different points in a wash cycle and/or to configure a wash cycle to use either external or container sprayers. Control 430 may be an electronic actuator in some embodiments, which may be controlled and/or powered, for example, using a signal provided using the dock detection configuration discussed above in connection with FIGS. 8-11, or using dedicated wiring. In addition, as noted above, spray basket 400 may also include an electrical component suitable for signaling to the controller that the spray basket is a particular type of spray device so that the controller can control spray basket 400 accordingly. In still other embodiments, a spray basket may also signal to the controller a position or state of a user actuated control, e.g., so that a controller may configure a wash cycle based upon whether the external or container sprayers have been selected by a user.

Figure 30:
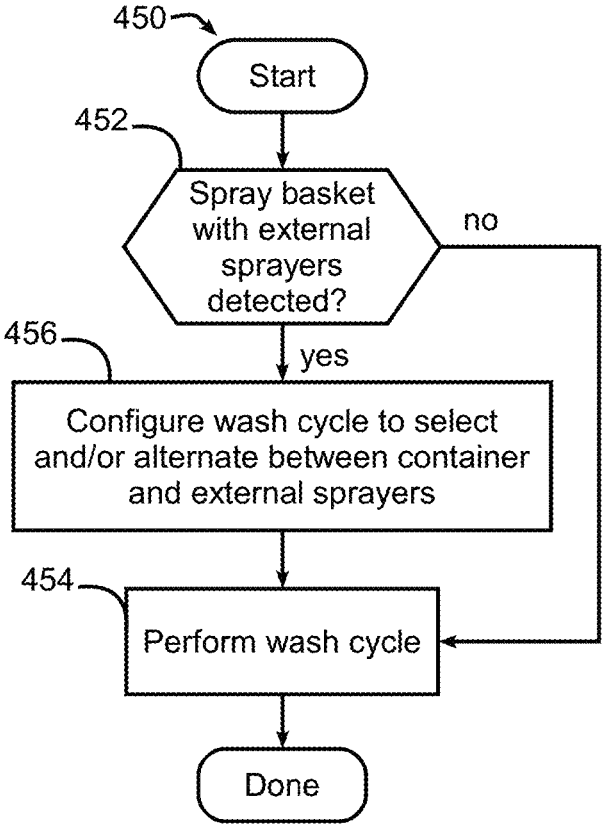
FIG. 30 is a flowchart illustrating an example sequence of operations for operating a dishwasher using the spray container of FIG. 26.

In one example embodiment, and is illustrated by sequence of operations 450 of FIG. 30, controller 30 may specifically configure a wash cycle based upon the presence of a spray basket with external sprayers. For example, as shown in block 452, controller 30 may, at the start of a wash cycle, determine whether a spray basket with external sprayers has been detected. In some embodiments, for example, controller 30 may apply a voltage across a dock detection mechanism at the start of a cycle and sense continuity to detect that spray basket 400 is docked to a docking port. In some embodiments, the dock detection mechanism may also supply power to the fluid supply control mechanism of spray basket 400, so once the spray basket is detected, controller 30 may shut off the voltage to the dock detection mechanism once polling is complete. Further, in some embodiments, controller 30 may be able to determine based upon a characteristic of the signal returned by the dock detection mechanism that the docked spray device is a spray basket with external sprayers. In other embodiments, other manners of detecting whether a spray basket with external sprayers has been detected may be used, e.g., the use of dedicated wires and/or switches, e.g., when no modular docking system is used.

If no spray basket with external sprayers is detected, block 452 passes control to block 454 to perform a wash cycle in a standard manner. On the other hand, if a spray basket with external sprayers is detected, block 452 passes control to block 456 to configure the wash cycle to select and/or alternate between container and external sprayers, before passing control to block 454 to perform the wash cycle configured in block 456.

As one example, in some embodiments a user may be able to select a wash mode via user interface 50 (FIG. 2), and controller 30 may configure spray basket 400 based upon the selected wash mode. For example, if a user selects a power wash mode the controller may configure spray basket 400 (e.g., using an electrical actuator driven by a voltage supplied to the dock detection mechanism) to select the external sprayers, while if a user selects a silverware or drinkware wash mode the controller may configure spray basket 400 to select the container sprayers. In another embodiment, however, the configuration of spray basket 400 may be independent of user selection of a mode, e.g., such that if spray basket 400 is detected, controller 30 alternates or sequences between external and container sprayers at different points in a wash cycle.

Returning to FIGS. 26-29, it will also be appreciated that in some embodiments, control 430 may be hydraulically controlled or may be mechanically controlled via a mechanical linkage controlled by the controller (e.g., a lever or arm disposed in the wash tub and positioned to actuate diverter 428 when the spray basket and rack upon which it is supported are arranged within the wash tub in an operating position. Thus, in various embodiments, the operation of a spray basket may be controlled by a user or by a dishwasher controller to actuate one or both of external and container sprayers during a wash cycle.

It will be appreciated that various modifications may be made to the embodiments discussed herein, and that a number of the concepts disclosed herein may be used in combination with one another or may be used separately. For example, the various spray container designs discussed herein, such as the silverware basket with integrated interior sprayer, the cup tree with integrated sprayer, the drinkware basket with integrated sprayer, and the spray basket with external power wash zone may each be used individually, and may be used in dishwashers lacking the rack manifold designs discussed herein, and in some embodiments, may be supported in areas of a dishwasher other than a rack. Furthermore, the herein-described rack manifold with modular docking and/or dock detection may be used with other types of spray containers.

Various additional modifications may be made to the illustrated embodiments consistent with the invention. Therefore, the invention lies in the claims hereinafter appended.

What is claimed is:

1. A dishwasher, comprising:

a wash tub;

a pump configured to recirculate fluid within the wash tub;

a controller electrically coupled to the pump;

a port disposed on a wall of the wash tub and in fluid communication with the pump;

a rack disposed in the wash tub and configured to support a plurality of utensils to be washed, wherein the rack is configured to move between loading and washing positions along a horizontal direction;

a manifold coupled to the rack and including a fluid inlet in fluid communication with the pump and a docking port in fluid communication with the fluid inlet, wherein the fluid inlet of the manifold is configured to mate with the port disposed on the wall of the wash tub when the rack is moved to the washing position such that the manifold is in fluid communication with the pump when the rack is moved to the washing position;

a dock detector coupled to the docking port and configured to detect docking of a spray device connector to the docking port; and first and second electrical conductors extending along the manifold between the fluid inlet and the docking port, the first and second electrical conductors electrically coupled to the dock detector to communicate an electrical signal between the dock detector and the controller to indicate when the spray device connector is docked to the docking port;

wherein the fluid inlet and the port disposed on the wall of the wash tub include cooperative electrical contacts, the electrical contacts of the port being electrically coupled to the controller and the electrical contacts of the fluid inlet being electrically coupled to the first and second electrical conductors.

2. The dishwasher of claim 1, wherein the dock detector comprises first and second conductive pads respectively and electrically coupled to the first and second electrical conductors, wherein the first and second conductive pads are disposed proximate the docking port and electrically isolated from one another when no spray device connector is docked to the docking port, and wherein the first and second conductive pads are electrically coupled to one another when the spray device connector is docked to the docking port.

3. The dishwasher of claim 2, wherein the spray device connector includes one or more conductive surfaces configured to mate with each of the first and second conductive pads when the spray device connector is docked to the docking port.

4. The dishwasher of claim 3, wherein the first and second conductive pads are disposed in a common plane and circumscribe an opening of the docking port, and wherein the one or more conductive surfaces of the spray device connector include an annular conductive surface that mates with the first and second conductive pads when the spray device connector is docked to the docking port.

5. The dishwasher of claim 1, wherein the dock detector includes a continuity detector that electrically couples the first and second electrical conductors to one another when the spray device connector is docked to the docking port.

6. The dishwasher of claim 1, wherein the dock detector includes a contact switch having open and closed states and including first and second contacts, at least one of the first and second contacts configured to be displaced when the spray device connector is docked to the docking port to switch between the open and closed states.

7. The dishwasher of claim 1, wherein the dock detector includes a magnetic sensor having open and closed states and including first and second contacts, at least one of the first and second contacts configured to be displaced in response to a magnetic field, wherein the spray device connector includes a magnet such that the at least one of the first and second contacts is displaced to switch the magnetic sensor between the open and closed states when the spray device connector is docked to the docking port.

8. The dishwasher of claim 1, wherein the dock detector includes an inductive proximity sensor, a capacitive proximity sensor, a magnetic proximity sensor, a photoelectric proximity sensor, an optical sensor or a Hall Effect sensor configured to detect when the spray device connector is docked to the docking port.

9. The dishwasher of claim 1, wherein the dock detector includes a wireless sensor configured to detect a wireless signal generated by a passive or active element on the spray device connector.

10. The dishwasher of claim 1, wherein the manifold includes a fluid conduit, wherein the docking port is disposed on the fluid conduit, and wherein the first and second electrical conductors extend along the fluid conduit.

11. The dishwasher of claim 10, wherein the first and second electrical conductors are embedded in the fluid conduit.

12. The dishwasher of claim 10, wherein the first and second electrical conductors are formed on an inner or outer surface of the fluid conduit.

13. The dishwasher of claim 1, wherein the manifold further includes:

a plurality of docking ports in fluid communication with the fluid inlet, the plurality of docking ports disposed at a plurality of locations in the rack;

a plurality of valves respectively coupled to the plurality of docking ports, each valve configured to seal the respective docking port when the respective docking port is unused; and a plurality of dock detectors respectively coupled to the plurality of docking ports and configured to detect docking of a spray device connector to the respective docking ports.

14. The dishwasher of claim 13, wherein the plurality of dock detectors are electrically coupled to the first and second electrical conductors, and wherein the controller is configured to determine when the spray device connector is docked to any of the plurality of docking ports.

15. The dishwasher of claim 14, wherein the plurality of dock detectors are coupled in parallel to one another, and wherein the spray device connector forms a bridge between the first and second electrical conductors when docked to one of the plurality of docking ports.

16. The dishwasher of claim 13, wherein each of the plurality of dock detectors is electrically coupled to the controller using at least one dedicated electrical conductor, and wherein the controller is configured to determine to which of the plurality of dock detectors the spray device connector is docked.

17. The dishwasher of claim 13, wherein the manifold further includes at least one electrical component associated with a first docking port among the plurality of docking ports and configured to communicate a signal to the controller, and wherein the controller is configured to determine that the spray device connector is docked to the first docking port based upon the signal communicated by the at least one electrical component.

18. The dishwasher of claim 17, wherein the at least one electrical component is a passive electrical component that communicates the signal by varying an electrical characteristic of an input signal communicated to the electrical component to identify the first docking port to the controller.

19. The dishwasher of claim 17, wherein the at least one electrical component is an active electrical component that generates an analog or digital signal to identify the first docking port to the controller.

20. The dishwasher of claim 1, wherein the docking port is configured to couple with a plurality of different types of spray devices, and wherein the dock detector is configured to determine a spray device type when the spray device connector is docked to the docking port.

21. The dishwasher of claim 1, wherein the first and second electrical conductors are configured to supply electrical power to the spray device connector when the spray device connector is docked to the docking port to control a motor, valve or electrical circuit of a spray device.

22. The dishwasher of claim 1, wherein the controller is configured to poll the dock detector to determine whether the spray device connector is docked to the docking port and control at least one wash cycle parameter during a wash cycle in response to determining that the spray device connector is docked to the docking port.

23. The dishwasher of claim 22, wherein the wash cycle parameter is a wash segment time, a wash cycle time, a fluid pressure, a fluid amount, a fluid temperature, a diverter valve setting, or a control valve setting.

* * * * *